US006607192B2

(12) United States Patent
Ono et al.

(10) Patent No.: US 6,607,192 B2
(45) Date of Patent: Aug. 19, 2003

(54) SHEET FEEDER AND SHEET FEEDING METHOD FOR PLATE-SHAPED MEMBERS

(75) Inventors: Tsukasa Ono, Kanagawa (JP); Takashi Koizumi, Kanagawa (JP)

(73) Assignee: Fuji Photo Film, Ltd., Kanagawa (JP)

( * ) Notice: Subject to any disclaimer, the term of this patent is extended or adjusted under 35 U.S.C. 154(b) by 1 day.

(21) Appl. No.: 09/983,605

(22) Filed: Oct. 25, 2001

(65) Prior Publication Data

US 2002/0047234 A1 Apr. 25, 2002

(30) Foreign Application Priority Data

Oct. 25, 2000 (JP) ..... 2000-325267

(51) Int. Cl.[7] ..... B65H 3/08
(52) U.S. Cl. ..... 271/90; 271/104; 271/107
(58) Field of Search ..... 271/90, 104, 107

(56) References Cited

U.S. PATENT DOCUMENTS 4,921,237 A * 5/1990 Nubson et al. ..... 271/11
5,100,121 A * 3/1992 Takei et al. ..... 271/104
5,253,858 A * 10/1993 Grieve ..... 271/103
6,412,770 B1 * 7/2002 Demmeler ..... 271/94
6,450,493 B1 * 9/2002 Milillo et al. ..... 271/11
2002/0101026 A1 * 8/2002 Kaya et al. ..... 271/100

* cited by examiner

*Primary Examiner*—Donald P. Walsh
*Assistant Examiner*—Kaitlin Joerger
(74) *Attorney, Agent, or Firm*—Sughrue Mion, PLLC

(57) ABSTRACT

A sheet feeding method for plate-shaped members is disclosed. In a sucker unit, suction nozzles are move down from respective original positions toward a bottom plate of a cassette at a fixed speed, and time t1 until the bottom plate is detected by a contact sensor, and an amount by which the suction nozzles move, Δy, until the suction nozzles suction adhere to the bottom plate after the bottom plate is detected by the contact sensor are measured. Subsequently, separation positions of the suction nozzles with respect to the original positions are set based on an interval between the bottom plate of the cassette and separation plates, and an interval required by the photopolymer plate being bent between the suction nozzles and the separation plates at an appropriate curvature. Based on the result of the setting, the photopolymer plate is reliably taken out from the cassette.

20 Claims, 13 Drawing Sheets

SHEET FEEDER AND SHEET FEEDING METHOD FOR PLATE-SHAPED MEMBERS

BACKGROUND OF THE INVENTION

1. Field of the Invention

The present invention relates to a sheet feeder and sheet feeding method for plate-shaped members, in which thin plate-shaped members such as printing plates stacked on a bottom plate of a cassette, are taken out one-by-one from the uppermost layer by being sucked to a plurality of suckers.

2. Description of the Related Art

A technique has been developed, wherein a printing plate such as a photopolymer plate having a photosensitive layer (for example, a photopolymerization layer) provided on a support is used and an image is directly recorded on the photosensitive layer (photopolymerization layer) of the printing plate by a laser beam or the like (an automatic exposure apparatus for printing plates). In such a technique, an image can be rapidly recorded on the printing plate.

In the automatic exposure apparatus for printing plates, when a cassette in which a large number of printing plates in a stack are accommodated, is mounted at a predetermined position, the printing plates are taken out by a sheet feeder one-by-one from the uppermost printing plate and transferred to an exposure section.

In a cassette, the printing plates may be stacked with interleaf papers interposed therebetween so as to protect the printing surfaces of the plates. The printing plates and the interleaf papers are alternately stacked with one another, and scratching or the like of the photosensitive layer and the support for a printing plate adjacent thereto, contacting each other, is prevented. In the sheet feeder in which the printing plates stacked as described above are taken out from the cassette one-by-one, an uppermost interleaf paper is removed, and thereafter, the uppermost printing plate within the cassette is lifted up by being sucked to a plurality of suckers (suction cups) which are disposed so as to face each other along one end of the printing plate.

In the sheet feeder, it is necessary that the plurality of suckers closely contact the printing plate so that the printing plate may be reliably suction adhered to the suckers. Accordingly, adjustment of position is required in the sheet feeder so as to allow the plurality of suckers to contact the uppermost printing paper substantially at the same time.

There are cases in which the cassette is provided with separation plates which are provided such that the peripheral edge of a printing plate is caught by the separation plates when the printing plate sucked to the suckers is lifted up. The separation plates are mounted at predetermined positions in the cassette and bends the printing plate sucked to the suckers, between the separation plates and the suckers by lifting up the printing plate to a predetermined height with respect to the separation plates. As a result, an interleaf paper closely contacting the raised printing plate, or a subsequent printing plate is separated from the raised printing plate. Accordingly, only the uppermost printing plate can be taken out from the cassette.

However, in the sheet feeder as described above, positions at which a plurality of suckers are mounted, need to be precisely adjusted at the time of assembling in order that plate-shaped members such as printing plates be reliably suction adhered to the plurality of suckers. Further, it is necessary that an end of the plate-shaped member be bent between the separation plates and the suckers at an appropriate curvature so as to reliably raise only one plate-shaped member. Accordingly, it is necessary that positions to which the suckers suction adhering to the plate-shaped member are moved, be precisely adjusted with respect to the separation plates mounted in the cassette.

The above-described adjustment of position results in that assembling of the sheet feeder may be complicated. Further, when maintenance, for example, replacement of parts such as suckers is carried out, adjustment of positions thereof may be required again. As a result, maintenance becomes complicated.

SUMMARY OF THE INVENTION

The present invention has been devised in view of the above-described circumstances, and an object thereof is to achieve improvement in assembling efficiency by facilitating adjustment at the time of assembling and provide a sheet feeding method for plate-shaped members, in which plate-shaped members stacked on a bottom plate of a cassette can be reliably taken out one-by-one by a plurality of suckers.

In order to achieve the above-described object, a first aspect of the present invention is a sheet feeding method for plate-shaped members, in which the uppermost layer of plate-shaped members stacked on a bottom plate of a cassette which is disposed so as to face predetermined positions of a plurality of suction nozzles, is raised by being suction adhered to the plurality of suction nozzles and taken out from the cassette. In this method, the suction nozzles are moved from preset original positions thereof to the bottom plate of the cassette at a predetermined speed, the state in which the suction nozzles have come close to the uppermost plate-shaped member and moved to a predetermined position, is detected by an approach detecting device, and the suction nozzles are moved downward based on an amount of movement which is set so that the plurality of suction nozzles each abut against the plate-shaped member, thereby allowing the suction nozzles to suction adhere to the uppermost plate-shaped member.

According to the present invention, the suction nozzles are moved downward to positions which are previously set so that all of the suction nozzles abut against the plate-shaped member. As a result, even if the positions at which the suction nozzles are mounted, may not be located at the same height, the plate-shaped member can reliably be suction adhered to all of the suction nozzles.

Accordingly, no high accurate positioning of the suction nozzles at the time of assembling is required, and an assembling operation of the suction nozzles becomes easy.

In the present invention, preferably, the plurality of suction nozzles and the approach detecting device are integrally moved toward the bottom plate of the cassette having no plate-shaped member accommodated therein, and the state in which the suction nozzles have come close to the bottom plate of the cassette and moved to a predetermined position, is detected by the approach detecting device, a distance by which the suction nozzles move until a detected pressure of a pressure detecting device disposed between the suction nozzles and a negative pressure source reaches a predetermined value, and the distance by which the suction nozzles move, is set as the amount of movement.

According to the present invention, an amount by which the suction nozzles move until all of the suction nozzles suction adhere to the bottom plate of the cassette after the bottom plate of the cassette has been detected by the approach detecting device, is previously measured and set. That is, the position at which the plate-shaped member is reliably suction adhered to a suction nozzle which has not been mounted at the same height as others, is set.

As a result, the operation of setting the position at which the plate-shaped member is reliably suction adhered to the plurality of suction nozzles, and setting the amount by which the suction nozzles move, is automated and the setting operation can be carried out simply.

Further, according to the first aspect of the present invention, preferably, when the suction nozzles suction adhering to the plate-shaped member is moved upward to a predetermined position with respect to separation plates provided in the cassette at predetermined positions facing a peripheral edge of the plate-shaped member, so that the plate-shaped member is bent between the suction nozzles and the separation plates at a predetermined curvature, respective positions of the suction nozzles with respect to the original positions are set based on a distance by which the suction nozzles move from the original positions until the suction nozzles suction adhere to the bottom plate of the cassette.

According to the above-described structure, based on the speed at which the suction nozzles move downward, and the time in which the suction nozzles move downward, proper positions at which the plate-shaped member is separated by the suction nozzles, are set with respect to the original positions of the suction nozzles. As a result, adjustment of the original positions of the suction nozzles at the time of assembling, and adjustment of the separation positions can be simplified, and assembling efficiency of the sheet feeder by which the plate-shaped members can be reliably taken out one-by-one can be improved.

A second aspect of the present invention is a method for removing a plate-shaped member for sheet feeding from a stack of plate-shaped members supported on a bottom plate of a cassette, the method comprising the steps of: positioning suction nozzles at preset original positions relative to the bottom plate of the cassette, facing the stack; moving the suction nozzles from the preset original positions to a first position in close proximity to the stack based on information from an approach detection mechanism; moving the suction nozzles an additional amount predetermined to abut each suction nozzle against the stack; withdrawing the suction nozzles from the stack while applying reduced pressure to the suction nozzles to suction adhere a plate shaped member thereto and remove the plate-shaped member from the stack for sheet feeding.

A third aspect of the present invention is a sheet feeder for plate-shaped members, comprising: a cassette in which plate-shaped members are accommodated in a stack; a suction unit including at least one suction nozzle which is capable of suction adhering to a plate-shaped member when supplied with reduced pressure, a frame supporting the suction nozzle, and a motor which drives movement of the frame so that the suction nozzle is moved close to and apart from a plate-shaped member in the cassette, and a control system which controls operation of the motor for controlling a distance between the suction nozzle and the plate-shaped member.

As described above, the present invention has an excellent effect in that positions at which suction nozzles are mounted at the time of assembling of a sheet feeder, and original positions of the suction nozzles can be adjusted extremely easily, thereby improving assembling efficiency of the suction nozzles and facilitating maintenance thereof.

BRIEF DESCRIPTION OF THE DRAWINGS

FIG. 9A shows a state in which the suckers are separated from the bottom plate of the cassette; and FIG. 9B shows a state in which all the suckers are in contact with the bottom plate of the cassette.

DESCRIPTION OF THE PREFERRED EMBODIMENTS

Figure 1:
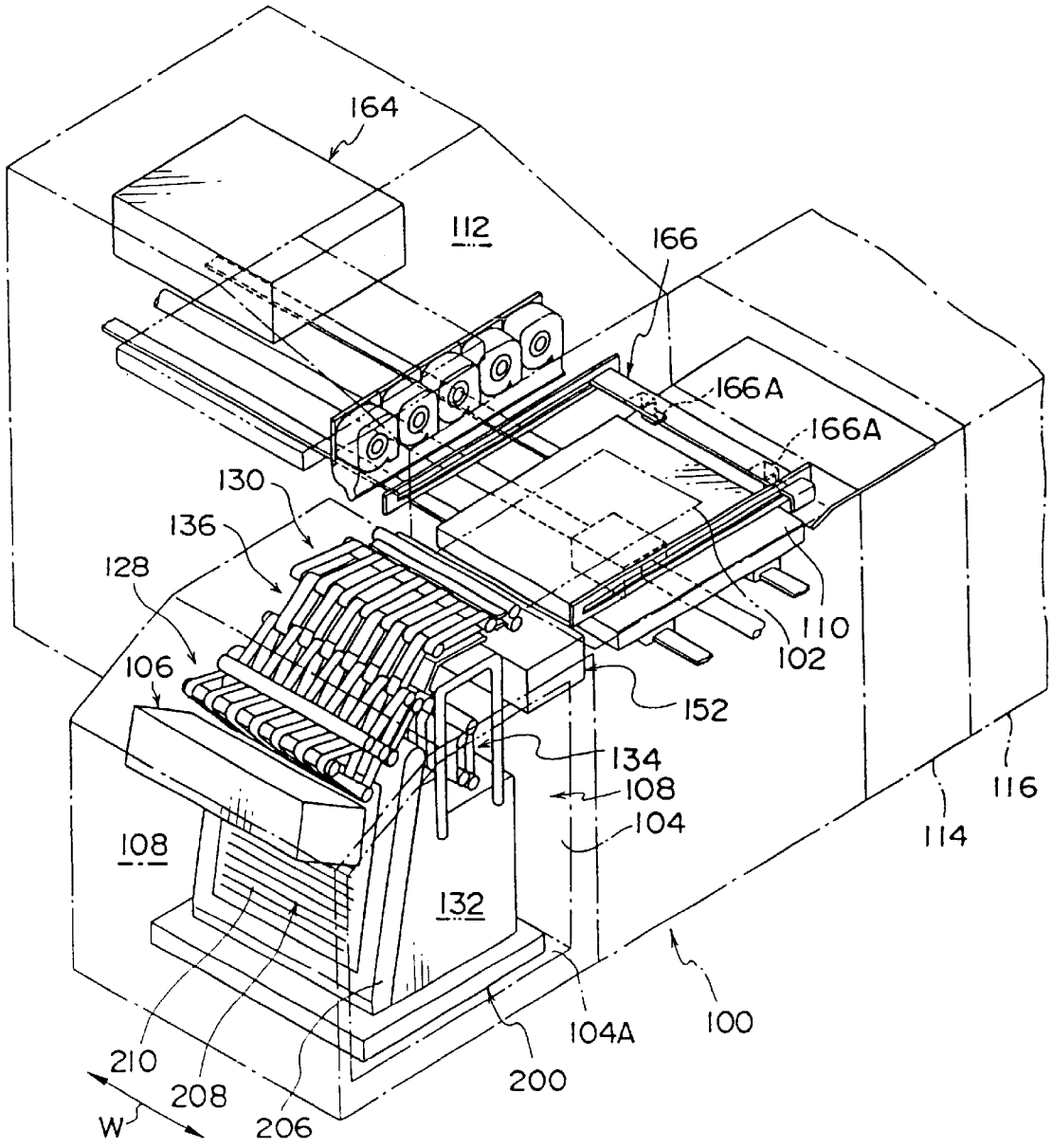
FIG. 1 is a structural diagram which schematically shows an automatic exposure apparatus applied to an embodiment of the present invention.

FIG. 1 shows an automatic exposure apparatus 100 according to an embodiment of the present invention. The automatic exposure apparatus 100 includes a sheet feeding section 106 by which a plate accommodating section 104, in which photopolymer plates 102 (see FIG. 3) placed on a carriage 200 are accommodated, and the photopolymer plates 102 accommodated in the plate accommodating section 104 are removed, a surface table 110 for positioning and holding the photopolymer plates 102, a plate supplying section 108 for transferring the photopolymer plates 102 removed by the sheet feeding section 106 to the surface table 110, and an exposure section 112 in which an image is recorded on a photopolymer plate 102 positioned on the surface table 110.

An automatic processing apparatus 116 can be provided at a downstream side of the automatic exposure apparatus 100 via a buffer section 114, and supplying of plates, exposure, and processing can all be automatically processed.

Figure 2:
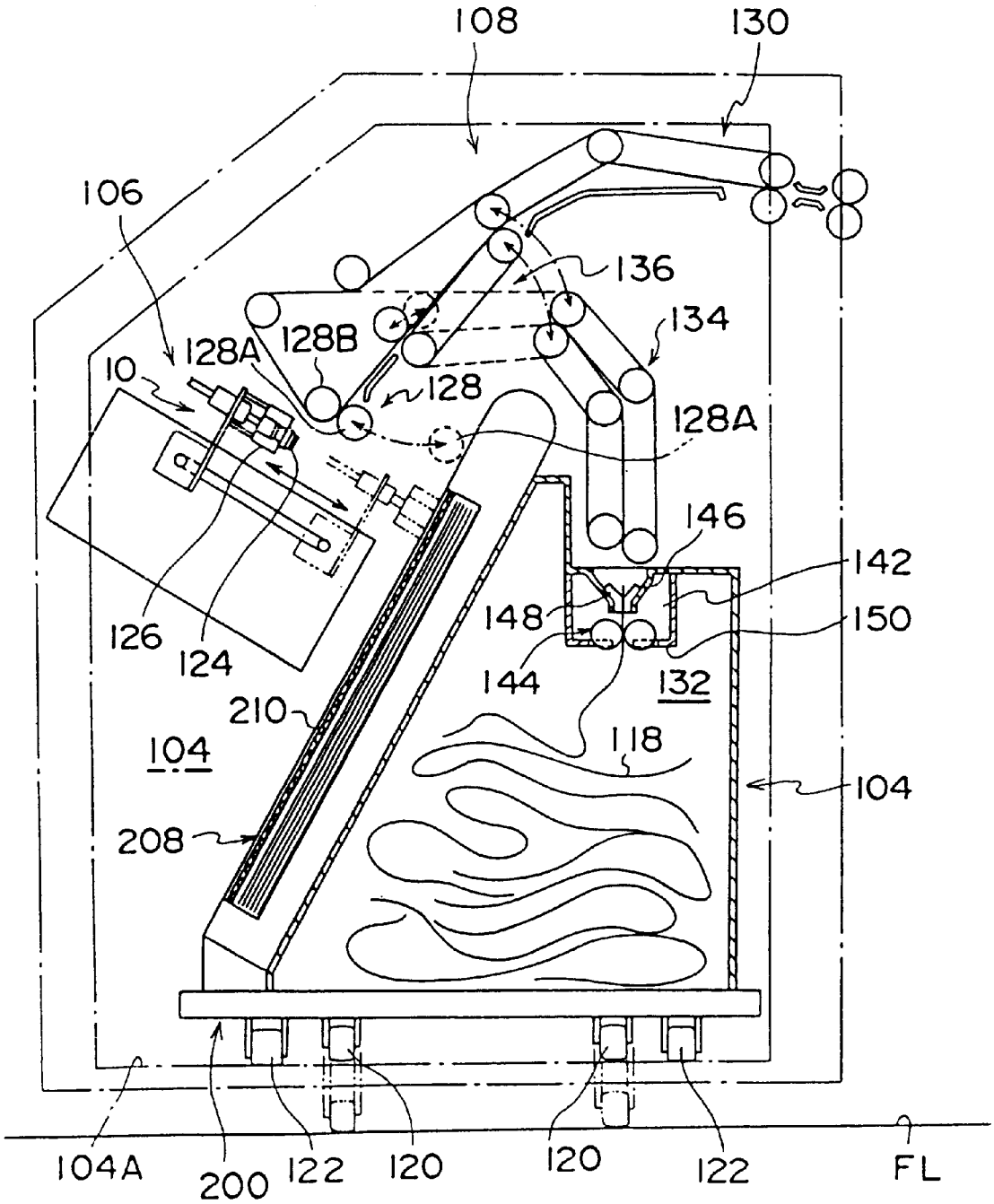
FIG. 2 is a structural diagram which schematically shows the main portion of the automatic exposure apparatus having the sheet feeding section to which the present invention is applied.

As illustrated in FIG. 2, the plate accommodating section 104 includes a floor portion 104A at a position higher than the floor surface FL on which the carriage 200 moves, and the carriage 200 is formed so as to ride on the floor portion 104A above the floor surface FL. The carriage 200 includes casters 120 which can each move to a position at which it projects from the carriage 200 (that is, the position indicated by the phantom lines in FIG. 2) and also to a position at which it is accommodated in the carriage 200 (that is, the position indicated by solid lines in FIG. 2). The carriage 200 can be moved by the casters 120 on the floor surface FL. Further, the carriage 200 is accommodated in the plate accommodating section 104 at a predetermined position in such a manner that the casters 120 are moved to the accommodated position so as to be made retractable toward the upper side corresponding to an operation of accommodating the carriage 200 in the plate accommodating section 104, and the carriage 200 moves by auxiliary rollers 122 on the floor portion 104A.

An accumulating portion 206 is provided in the carriage 200 and a cassette 208 is mounted in the accumulating portion 206 in such a manner as to be inclined at a predetermined angle. A large number of (for example, several tens of) photopolymer plates 102 are in advance accommodated on a bottom plate 212 of the cassette 208 in a stack, and the photopolymer plates 102 are loaded in the plate accommodating section 104 by mounting the carriage 200 in the plate accommodating section 104.

Figure 3:
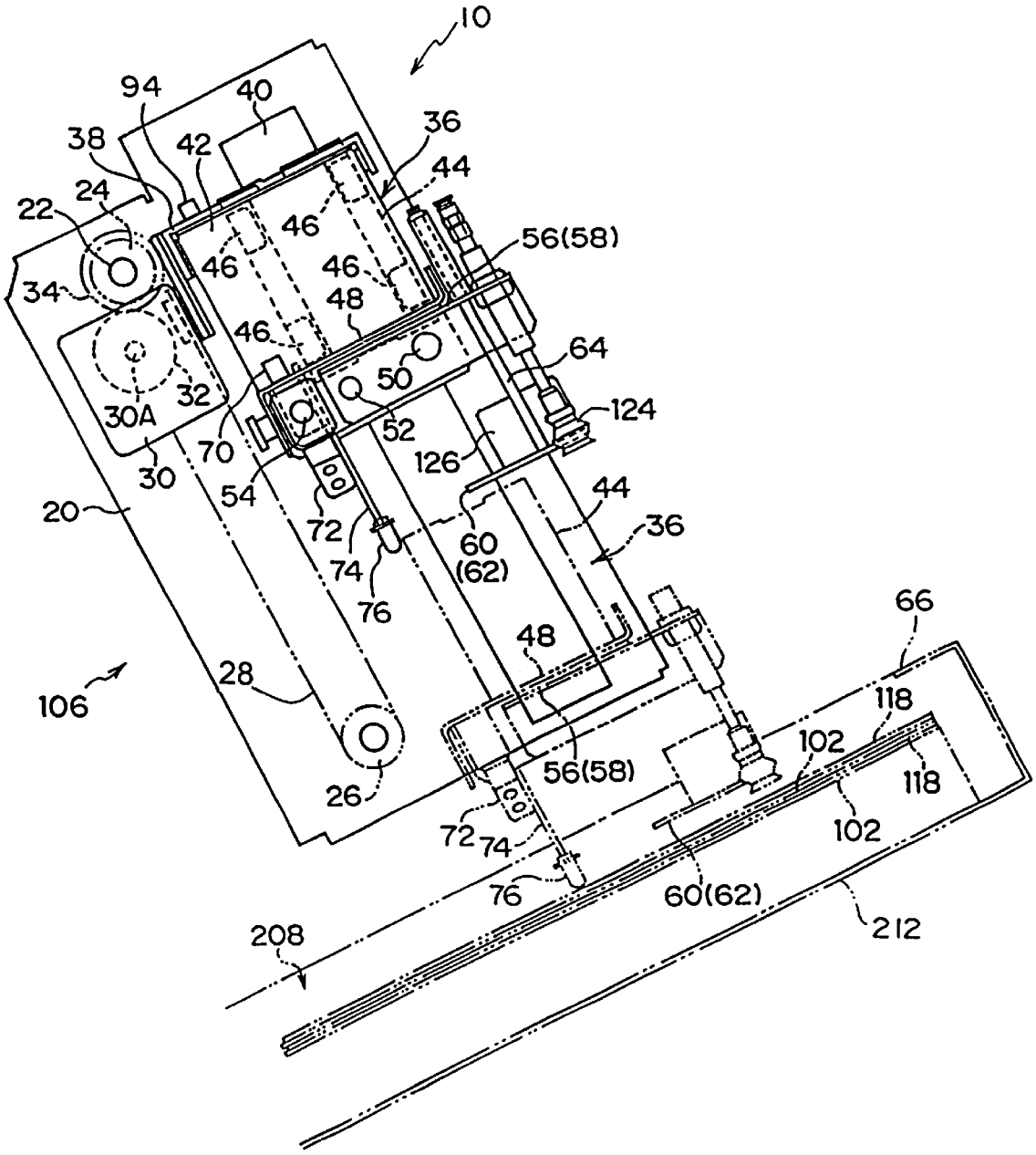
FIG. 3 is a schematic structural diagram of the sheet feeding section having the sucker unit to which the present invention is applied.

As shown in FIG. 3, the photopolymer plates 102 are each protected in such a manner that the surface thereof (on which a photosensitive layer formed by a photopolymerization layer is provided) is covered by interleaf paper 118. The photopolymer plates 102 and interleaf papers 118 are thus alternately stacked in the cassette 208. As shown in FIGS. 1 and 2, the cassette 208 is equipped with a shutter 210, and due to the shutter 210 being closed in cases other than when it is placed in a dark room, the photopolymer plates 102 are prevented from being undesirably exposed to light.

The photopolymer plates 102 are disposed to face the sheet feeding section 106 in a state of being inclined at a predetermined angle by mounting the carriage 200 in the plate accommodating section 104. The carriage 200 is placed in the plate accommodating section 104 and the plate accommodating section 104 is placed into a light shielding state, and the shutter 210 of the cassette 208 is opened. In this state, the photopolymer plates 102 can be removed from the cassette 208.

The sheet feeding section 106 provided above the plate accommodating section 104 is equipped with a plurality of suckers (or suction nozzles) 124. A predetermined position at an upper end of each of the interleaf paper 118 and the photopolymer plate 102 adheres to the suckers 124 when operated, and the interleaf paper 118 and the photopolymer plate 102 are sequentially removed from the cassette 208 and transferred to the plate supplying section 108.

The plate supplying section 108 is mainly divided into the following four parts: a shared conveying portion 128 in which the photopolymer plate 102 or interleaf paper 118 is received from the sheet feeding section 106 and conveyed; a photopolymer plate conveying portion 130 which receives the photopolymer plate 102 and conveys the same to the surface table 110; an interleaf paper conveying portion 134 which receives the interleaf paper 118 and conveys the same to an interleaf paper receiving box 132 provided in the carriage 200; and a conveying switch portion 136 which functions as a guide from the shared conveying portion 128 to any one of the photopolymer plate conveying portion 130 and the interleaf paper conveying portion 134 by a switching operation.

As shown in FIG. 2, in the shared conveying portion 128, a roller 128A is disposed apart from a roller 128B (indicated by the broken line in FIG. 2), and when the photopolymer plate 102 or the interleaf paper 118 is removed by the sheet feeding section 106 and raised to a position of delivery, the roller 128A moves toward the roller 128B (indicated by the solid line in FIG. 2) and nips and conveys the leading end of the raised photopolymer plate 102 or interleaf paper 118 to the conveying switch portion 136. When the interleaf paper 118 is taken out from the cassette 208, the conveying switch portion 136 is provided to switch the conveying path so as to convey the interleaf paper 118 to the interleaf paper conveying portion 134 (indicated by the broken line in FIG. 2). Further, when the photopolymer plate 102 is taken out from the cassette 208, the conveying switch portion 136 is provided to switch the conveying path so as to convey the photopolymer plate 102 to the photopolymer plate conveying portion 130 (indicated by the solid line in FIG. 2).

The carriage 200 is provided with the interleaf paper receiving box 132, and the interleaf paper 118 removed from the cassette 208 by the sheet feeding section 106 is guided by the interleaf paper conveying portion 134 to the interleaf paper receiving box 132 provided in the carriage 200. A pair of rollers 144 is provided at an insertion opening 142 for the interleaf paper 118, which is formed in an upper side of the interleaf paper receiving box 132. These rollers are driven to rotate at a linear velocity which is slightly higher (about 1.1 times) than the conveying speed in the interleaf paper conveying portion 134. As a result, when the interleaf paper 118 extends across a region between the interleaf paper conveying portion 134 and the rollers 144, it is conveyed while maintaining a predetermined tension therein, and occurrence of jamming caused by a slack or the like can be prevented.

Further, guide plates 146 formed in such a manner that a distance therebetween (in a direction along a thickness of the interleaf paper 118) gradually decreases from top to bottom in a tapered manner, are provided at the upstream side of the insertion opening 142 in the direction of the conveying path of the interleaf paper 118. The guide plates 146 formed in the tapered shape and facing each other are each provided with a charge removing brush 148 so as to remove electric charge (static electricity) from the interleaf paper 118 to be inserted in the insertion opening 142.

The pair of rollers 144 are skewered rollers. Partition plates 150 (disposed at the side of the rollers) have recesses which are complementary to the rollers of the skewered rollers, such that the rollers are disposed within these recesses. As a result, even if a portion of the interleaf paper 118 received in the interleaf paper receiving portion 132 contacts the rollers 144, lapping of the interleaf paper 118 around the rollers 144 can be prevented by the partition plates 150.

On the other hand, when the photopolymer plate 102 is removed from the cassette 208, the conveying switch portion 136 switches the conveying path so as to guide the photopolymer plate 102 to the photopolymer plate conveying portion 130. Thereafter, the photopolymer plate 102 is transferred by the photopolymer plate conveying portion 130 to the surface table 110 (see FIG. 1) in a state of being conveyed substantially horizontally.

As illustrated in FIG. 1, the upper surface of the surface table 110 is disposed at a position lower than a position at which the photopolymer plate is horizontally conveyed in the photopolymer plate conveying portion 130. Further, there is a space or gap between the surface table 110 and the photopolymer plate conveying portion 130 in the direction in which the photopolymer plate is conveyed. For this reason, the photopolymer plate 102 conveyed from the photopolymer plate conveying portion 130 arrives at the surface table 110 in such a manner that the leading end thereof slightly hangs, and the trailing end of the photopolymer plate 102 in the conveying direction is positioned further at the upstream side of the surface table 110 in the conveying direction of the plate 102. A movable body 152 is provided at this upstream side of the surface table 110 so as to be capable of moving close to and apart from the surface table 110.

The movable body 152 includes a temporary supporting plate, a pushing plate, a puncher, and the like, which are all not shown. Hanging of the photopolymer plate 102 conveyed onto the surface table 110 is prevented by the temporary supporting plate.

Further, the pushing plate (not shown) provided in the movable body 152 pushes the trailing end of the photopolymer plate 102 so as to cancel a diagonal feed of the photopolymer plate 102, and the photopolymer plate 102 is conveyed to a predetermined reference position in the conveying direction. The reference position is set in such a manner that the trailing end of the photopolymer plate 102 in the conveying direction slightly protrudes from the surface table 110.

At the reference position, sensors (not shown) are respectively provided at plural positions including two corners at the trailing end of the photopolymer plate 102 in the conveying direction. Due to the trailing end of the photopolymer plate 102 being detected by the sensors, pushing by the pushing plate is stopped. Further, these sensors are also used to detect positions on the photopolymer plate 102 along the transverse direction perpendicular to the conveying direction. That is, the corners of the photopolymer plate 102 and the sensors are caused to coincide with each other by the surface table 110 moving in the transverse direction of the photopolymer plate 102 perpendicular to the conveying direction, and the position at which the corners of the photopolymer plate 102 and the sensors coincide with each other is registered as an initial position of the photopolymer plate 102.

The position of the photopolymer plate 102 moved to the initial position is set so as to become a relative position for a scanning/exposure starting position in the exposure section 112. In this state, the photopolymer plate 102 is sucked and held by negative pressure supplied to a suction groove (not shown) provided in the surface table 110. The puncher provided in the movable body 152 punches holes in the photopolymer plate 102 sucked and held by the surface table 110.

The surface table 110 is movable in a reciprocating manner (which is common to a movement for positioning in the transverse direction perpendicular to the conveying direction) at a uniform velocity between a first position (indicated by the solid line in FIG. 1) at which the photopolymer plate 102 is received from the photopolymer plate conveying portion 130 and a second position (indicated by the phantom line in FIG. 1) at which the photopolymer plate 102 is accommodated in the exposure section 112.

In the exposure section 112, a scanning unit 164 is provided at a position above the conveying path on the surface table 110. Main scanning (in a direction perpendicular to the moving direction of the surface table 110) is carried out using laser beams which are controlled so as to be modulated on in accordance with an image signal. Forward movement of the surface table 110 is sub-scan movement. Thus, during the forward movement of the surface table 110 to the exposure section 112, an image is recorded on the photopolymer plate 102 held on the surface table 110, and the photopolymer plate 102 is moved back to an original position by backward movement of the surface table 110. After the photopolymer plate 102 placed on the surface table 110 has been moved back to the original position, vacuum application is terminated thereby releasing the plate 102.

In correspondence to the surface table 110 on which the photopolymer plate 102 with an image being recorded is moved back to the original position, a discharging mechanism section 166 placed in a waiting state at the side of the trailing end of the photopolymer plate 102, in the conveying direction of the plate 102 by the photopolymer plate conveying portion 130, passes above the surface table 110 and moves to the leading end of the photopolymer plate 102.

The discharging mechanism section 166 is provided with hook portions 166A for supporting the trailing end of the photopolymer plate 102. Due to the trailing end of the photopolymer plate 102 protruding from the surface table 110 being lifted up by the temporary supporting plate provided in the movable body 152 and the discharging mechanism section 166 being moved in the direction in which the photopolymer plate 102 is conveyed, the photopolymer plate 102 is conveyed to the buffer section 114 at the downstream side of the surface table 110 by being caught by the hook portions 166A and accompanied with the movement of the discharging mechanism section 166. In the buffer section 114, the photopolymer plate 102 is smoothly conveyed out to the automatic processing apparatus 116 while eliminating a difference between a speed at which it is discharged by the discharging mechanism section 166 and a speed at which it is conveyed in the automatic processing apparatus 116.

Figure 4:
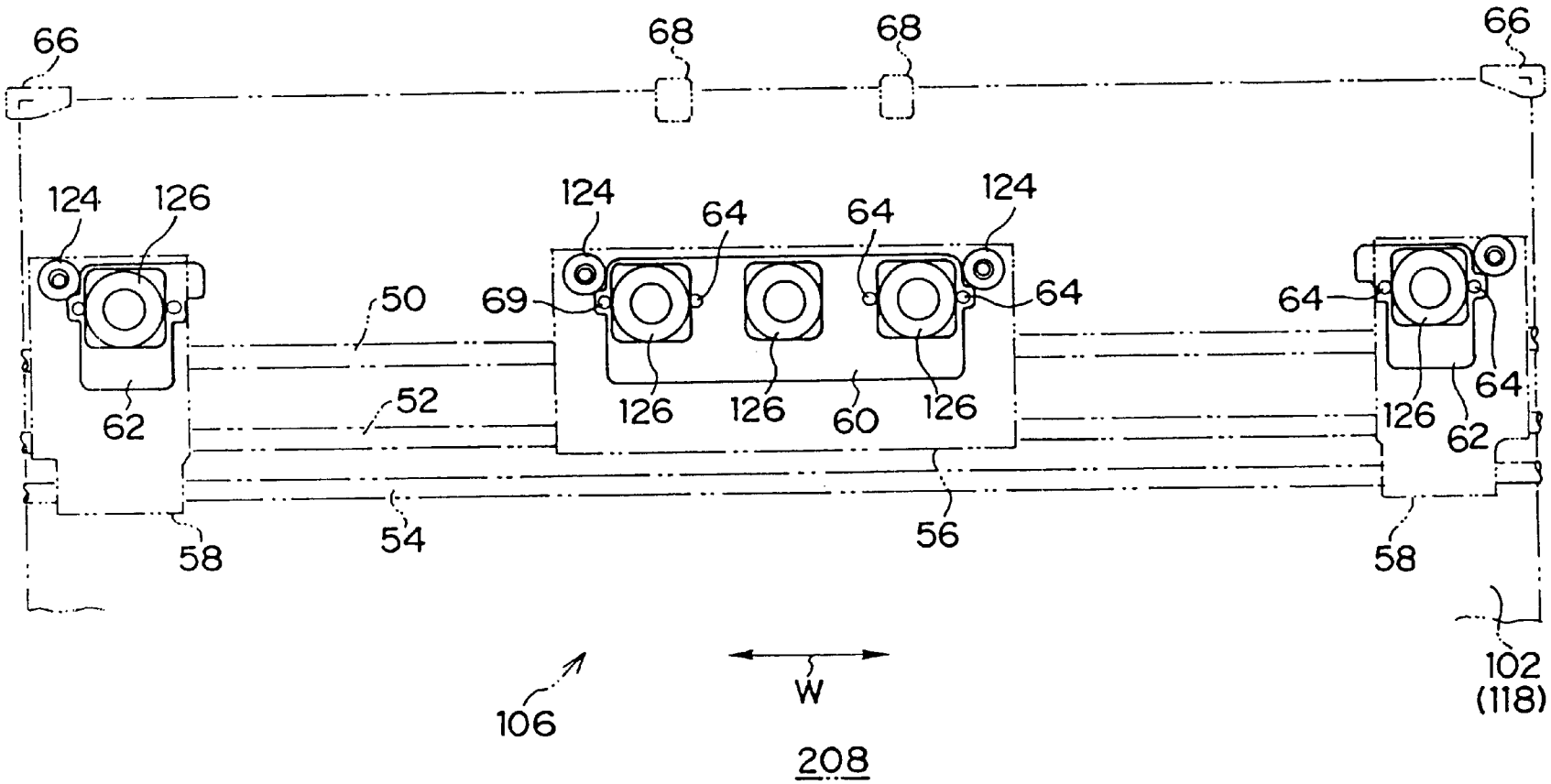
FIG. 4 is a schematic diagram of the main portion of the sucker unit, which shows relative positions of suckers and suction fans with respect to photopolymer plates accommodated in a cassette.
Figure 5:
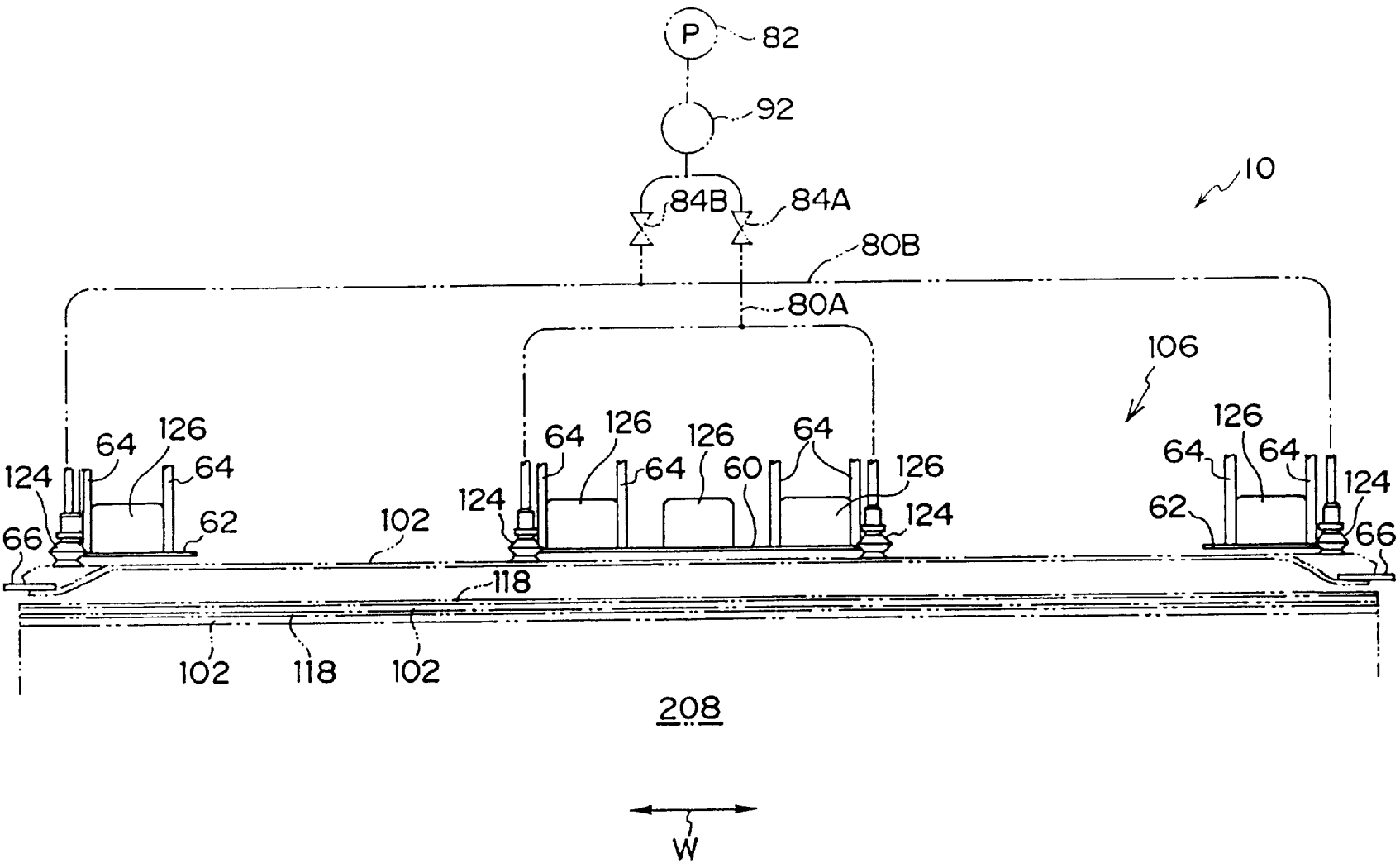
FIG. 5 is a schematic diagram of the main portion of the sucker unit, which shows the relative positions of the suckers and the suction fans with respect to photopolymer plates accommodated in the cassette, when seen from a side different from the view of FIG. 4.

FIGS. 3 to 5 each show the sheet feeding section 106 provided in the automatic exposure apparatus 100. In the embodiment of the present invention, the photopolymer plate 102, which is one kind of printing plate, is used as a plate-shaped member and the interleaf paper 118 is used as a sheet material. The photopolymer plates 102 and the interleaf papers 118 are accommodated in the cassette 208 in a state of being alternately stacked on the bottom plate 212. In FIGS. 4 and 5, the transverse direction of the photopolymer plate 102 (i.e., the direction perpendicular to the plane of FIG. 3) perpendicular to the direction in which the photopolymer plate 102 is conveyed between the shared conveying portion 128 and the photopolymer plate conveying portion 130, is indicated by a double-headed arrow W.

As illustrated in FIG. 3, the sheet feeding section 106 is provided with a pair of side plates 20 (in FIG. 3, only one of them is shown), and a sucker unit 10 is disposed between the pair of side plates 20. The cassette 208 placed on the carriage 200 is made to face the sucker unit 10 at a fixed position and also at a fixed interval with respect to the sucker unit 10 with the carriage 200 being mounted at a predetermined position in the plate accommodating section 104.

In the sucker unit 10, a shaft 22 is disposed so as to span between the pair of side plates 20 at upper portions of the side plates 20 (at the upper side in FIG. 3). Sprockets 24 are respectively mounted at both ends of the shaft 22 (at the sides of the side plates 20). Further, a sprocket 26 is mounted in the side plate 20 at the side of the cassette 208, and a chain 28 is entrained between and around the sprockets 24 and 26.

An elevating motor 30 serving as an elevator is mounted at one of the pair of side plates 20, and a gear 32 mounted on a driving shaft 30A of the elevating motor 30 meshes with a gear 34 mounted at the shaft 22. As a result, when the elevating motor 30 is driven, the sprockets 24 and 26 are rotated and the chain 28 is moved between the sprockets 24 and 26 in a direction substantially perpendicular to the surface of the photopolymer plates 102 stacked in the cassette 208.

The sucker unit 10 includes a suction frame 36 disposed between the side plates 20. The suction frame 36 is connected to the chain 28 via a bracket 38. Further, guide rails 40 are respectively mounted to the side plates 20 on the surfaces thereof facing each other. The suction frame 36 is provided with side bases 42 which face the side plates 20 respectively. Sliders 44 are mounted at the side bases 42 and each include plural pairs of frames 46 disposed with the guide rails 40 interposed therebetween.

As a result, when the elevating motor 30 is driven, the suction frame 36 moves along the guide rail 40 and moves up and down substantially perpendicular to the photopolymer plate 102 in the cassette 208.

As the elevating motor 30, a DC motor having an encoder, or a pulse motor is used. Accordingly, in the sucker unit 10, the speed at which the suction frame 36 moves, and the amount by which the suction frame 36 moves, can be properly controlled.

A supporting base 48 is provided in the bracket 38 of the suction frame 36 so as to face the cassette 208. Three shafts 50, 52, and 54 extend through the supporting base 48 along the transverse direction of the photopolymer plate 102.

As illustrated in FIG. 4, a bracket 56 is mounted so as to straddle over the shafts 50 and 52, and a bracket 58 is mounted so as to straddle over the shafts 50, 52, and 54. The brackets 56 and 58 are mounted, for example, in such a manner that the shafts 50, 52, and 54 pass through slide blocks (not shown) provided at the rear side thereof.

The bracket 56 faces a transverse-direction intermediate portion of the photopolymer plate 102 accommodated in the cassette 208, and the brackets 58 respectively face both the transverse-direction end portions of the photopolymer plate 102. The bracket 56 is fixed at a predetermined intermediate position between the shafts 50 and 52, and the brackets 58 are disposed respectively at sides of both ends of the shafts 50, 52, and 54 and can each be moved in directions in which it moves away and towards the bracket 56 in accordance with the size of the photopolymer plate 102 accommodated in the cassette 208 (this operation is not shown).

A fan base 60 is disposed below the bracket 56 and a fan base 62 is disposed below each of the brackets 58. The fan base 60 and the fan bases 62 are supported in such a manner as to be respectively connected to the brackets 56 and 58 by a plurality of shafts 64. As shown in FIG. 5, respective lower surfaces of the fan bases 60 and 62 are each disposed linearly and parallel to the surface of the photopolymer plate 102 accommodated in the cassette 208.

As illustrated in FIGS. 4 and 5, the fan base 60 is provided with plural (in the present embodiment, for example, three) suction fans 126 along the transverse direction of the photopolymer plate 102, and each of the fan bases 62 is provided with one suction fan 126. The suction fan 126 includes a vent opening portion at the central portion thereof, and is constructed to suck air from the fan bases 60 and 62 at the side of the cassette 208 by driving a fan motor (not shown) to blow out air upwardly (this operation is not shown).

As illustrated in FIG. 4, the bracket 56 is provided with the suction nozzles 124 which are respectively mounted at both sides of the bracket 56 with the fan base 60 interposed therebetween. The brackets 58 are each provided with the suction nozzle 124 mounted at an outer side of the bracket 58 along the transverse direction of the photopolymer plate 102. As illustrated in FIGS. 4 and 5, these suction nozzles 124 are each disposed near the suction fan 126.

An end of the suction nozzle 124 slightly protrudes from the rear surface of the fan base 60 or 62 toward the cassette 208. Further, when the end of the suction nozzle 124 abuts against the photopolymer plate 102 or the interleaf paper 118 and is pushed down, the suction nozzle 124 is apt to be flattened.

As shown in FIG. 5, the suction nozzles 124 are each connected to a negative pressure source such as a vacuum pump 82 via, for example a pipe line 80A or a pipe line 80B. Further, the pipe lines 80A and 80B are respectively provided with solenoid valves 84A and 84B. Due to the solenoid valves 84A and 84B being opened in a state in which the vacuum pump 82 is actuated, negative pressure is fed for each of the suction nozzles 124. At this time, since the suction nozzle 124 is apt to be flattened by abutting against the photopolymer plate 102 or the interleaf paper 118, the photopolymer plate 102 or the interleaf paper 118 can reliably be suction adhered by the suction nozzle 124.

The end of each of the suction nozzles 124 slightly protrudes from the rear surface of the fan base 60 or 62 and a predetermined stepped portion is formed between the end of the suction nozzle 124 and the lower surface of the fan base 60 or 62. When the suction nozzle 124 is made to abut against the photopolymer plate 102 or the interleaf paper 118, a small clearance is formed between the fan bases 60 and 62, and the photopolymer plate 102 or the interleaf paper 118 without the fan bases 60 and 62 contacting the surface of the photopolymer plate 102 or interleaf paper 118. As a result, the photopolymer plate 102 is prevented from being damaged due to the fan bases 60 and 62 contacting the photopolymer plate 102, and a suction efficiency of the suction fan 126 at the time of drawing in the interleaf paper 118 by suction, becomes higher.

In the sucker unit 10, when the interleaf paper 118 is taken out from the cassette 208, first, the suction fans 126 are actuated in a state of being moved close to the interleaf paper 118 with a predetermined space therebetween, and the interleaf paper 118 is lifted up due to suction force of the suction fans 126. Thereafter, the interleaf paper 118 is suction adhered to the suction nozzles 124.

Further, in the sucker unit 10, when the interleaf paper 118 is suction adhered to the suction nozzles 124, the suction frame 36 is moved upward to a position of delivery to the shared conveying portion 128 in which the interleaf paper 118 faces the rollers 128A and 128B of the shared conveying portion 128, and the interleaf paper 118 is nipped by the rollers 128A and 128B of the shared conveying portion 128. In this state, suction holding of the interleaf paper 118 by the suction nozzles 124 is released and the interleaf paper 118 is passed to the shared conveying portion 128.

Moreover, in the sucker unit 10, when the photopolymer plate 102 is taken out from the cassette 208, the suction frame 36 is moved downward to a position at which all of the suction nozzles 124 contact the photopolymer plate 102, and the photopolymer plate 102 is suction adhered to the suction nozzles 124. Thereafter, the suction frame 36 is moved upward to the position of delivery and the photopolymer plate 102 is lifted up and passed to the shared conveying portion 128.

As illustrated in FIGS. 3 to 5, the cassette 208 is provided with separation plates 66 at predetermined positions which face the peripheral edge of the photopolymer plate 102. When the photopolymer plate 102 is lifted up by the suction nozzles 124, the peripheral edge of the photopolymer plate 102 is caught by the separation plates 66 and thereby bends between the separation plates 66 and the suction nozzles 124 (see FIG. 5).

In the sucker unit 10, due to the suction nozzles 124 being lifted up to a predetermined height with respect to the separation plates 66 provided in the cassette 208, the photopolymer plate 102 is provided so as to bend between the suction nozzles 124 and the separation plates 66 at a predetermined curvature. Due to the photopolymer plate 102 being bent between the suction nozzles 124 and the separation plates 66 at an appropriate curvature, the photopolymer plate 102 is separated from an interleaf paper 118 lifted up by closely contacting a lower surface of the photopolymer plate 102, or from a subsequent photopolymer plate 102. As a result, only the uppermost photopolymer plate 102 can be lifted up from the cassette 208.

As illustrated in FIG. 4, the cassette 208 is also provided with interleaf paper keepers 68 which face the upper end of the interleaf paper 118. When the cassette 208 is mounted on the carriage 200 in an inclined manner, the interleaf paper keepers 68 are provided to abut against the uppermost interleaf paper 118 to prevent curling and falling of the interleaf paper 118, which is typically not firm.

Figure 6:
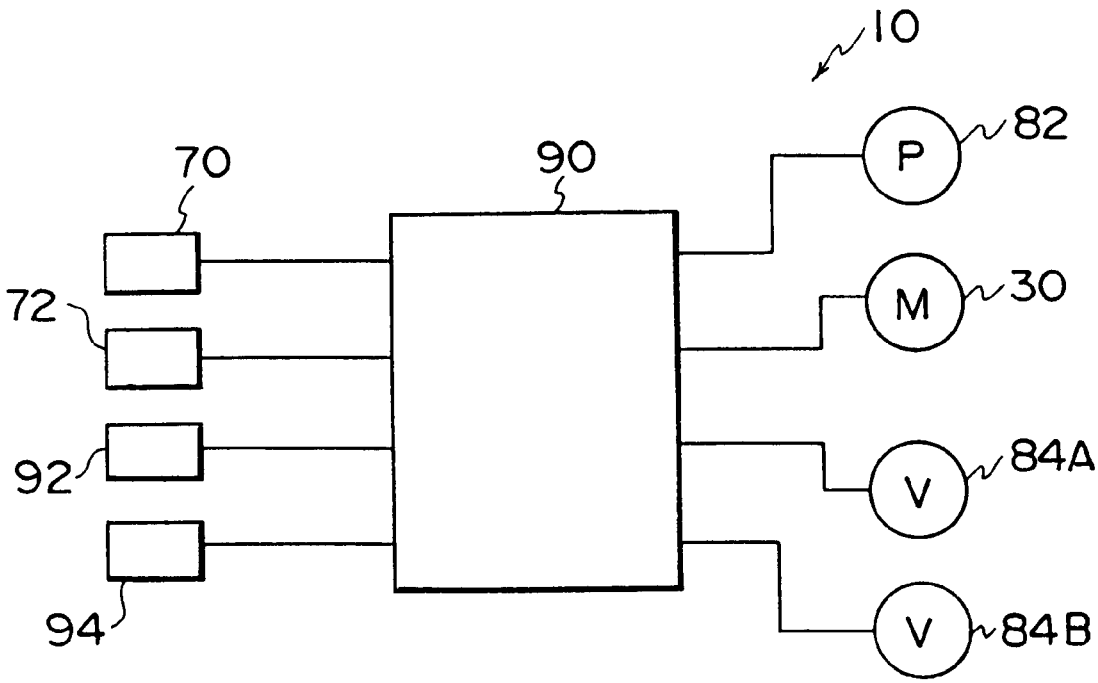
FIG. 6 is a block diagram which schematically shows connection to a sheet feeding controller provided in the sucker unit.

As illustrated in FIG. 6, the sucker unit 10 includes a sheet feeding controller 90 having a microcomputer. The sheet feeding controller 90 operates based on a signal from a main controller (not shown) of the automatic exposure apparatus 100, and controls takeout of the photopolymer plate 102 and the interleaf paper 118 from the cassette 208.

The elevating motor 30, vacuum pump 82, solenoid valves 84A and 84B, and the like are connected via a driver (not shown) to the sheet feeding controller 90. Further, a pressure sensor 92, an original position sensor 94, a plate/paper discrimination sensor 72, and a contact sensor 70 are also connected to the sheet feeding controller 90.

As illustrated in FIG. 3, the original position sensor 94 is provided at a predetermined position on the side plate 20. Due to the suction frame 36 moving to a predetermined position in a direction in which it moves apart from the cassette 208, the original position sensor 94 detects the bracket 38. The predetermined position is an original position (initial position) of the suction frame 36 (that is, the suction nozzles 124 and the like). Usually, the suction frame 36 is moved to the original position and placed in a waiting state thereat.

Further, the plate/paper discrimination sensor 72 is mounted at the bracket 58 so as to face the peripheral edge of the photopolymer plate 102 (that is, a non-image region) accommodated in the cassette 208. As the plate/paper discrimination sensor 72, for example, a reflection type photosensor is used. Light irradiated from a light projecting portion and reflected by the photopolymer plate 102 or the interleaf paper 118 is received by a light receiving portion.

At this time, an amount of the received light varies due to a difference in reflectance between the photopolymer plate 102 and the interleaf paper 118, and therefore, a determination can be made as to whether the uppermost layer is the photopolymer plate 102 or the interleaf paper 118. The distinction between the photopolymer plate 102 and the interleaf paper 118 may also be made, using a pressure sensor provided in a pipe line for feeding negative pressure for the suction nozzle 124, on the basis of the difference between a pressure generated when the interleaf paper 118 is suction adhered to the suction nozzle 124, and a pressure generated when the photopolymer plate 102 is suction adhered to the suction nozzle 124. That is, when the photopolymer plate 102 is located at the uppermost position, a predetermined negative pressure is detected by the pressure sensor. When the interleaf paper 118 is located at the uppermost position, negative pressure to be fed for the suction nozzle 124 leaks through the interleaf paper 118 and the negative pressure to be detected by the pressure sensor is reduced (approximately to zero).

Further, the contact sensor 70 is provided as an approach detecting device, and includes a detecting shaft 74 protruding from the supporting base 48 of the suction frame 36 toward an interior of the cassette 208. An abutting portion 76 is formed at an end of the detecting shaft 74. The abutting portion 76 of the detecting shaft 74 protrudes further toward the cassette 208 than the suction nozzles 124. When the suction frame 36 is moved downward from the original position thereof toward the cassette 208, the abutting portion 76 abuts against the photopolymer plate 102 or the interleaf paper 118 within the cassette 208 earlier than the suction nozzles 124.

The detecting shaft 74 contracts due to the abutting portion 76 abutting against the photopolymer plate 102 or the interleaf paper 118 which covers the upper surface (photosensitive surface) of the photopolymer plate 102. The contact sensor 70 is turned on due to contraction of the detecting shaft 74.

The sheet feeding controller 90 detects, based on the result of detection of the contact sensor 70, that the suction nozzles 124 provided in the suction frame 36 have moved to a predetermined position close to the photopolymer plate 102 or the interleaf paper 118 within the cassette 208.

In the sucker unit 10, the position at which the contact sensor 70 is turned on, is a position at which the interleaf paper 118 is drawn in by the suction fans 126. In the sheet feeding controller 90, when the interleaf paper 118 is located at the uppermost position of the cassette 208, downward movement of the suction frame 36 is stopped by turning on the contact sensor 70, and the suction fans 126 are actuated to start suction of the interleaf paper 118.

Further, in the sucker unit 10, an amount by which the suction nozzles 124 (suction frame 36) move until all of the suction nozzles 124 closely contact the photopolymer plate 102 from the time at which the contact sensor 70 is turned on, is previously set. As a result, in the sheet feeding controller 90, when the photopolymer plate 102 is located at the uppermost position of the cassette 208, the suction nozzles 124 are moved downward by the preset amount of movement by turning on the contact sensor 70 while feeding negative pressure for the suction nozzles 124, and the photopolymer plate 102 is reliably suction adhered to the suction nozzles 124.

The cassette 208 is assembled such that the bottom plate 212 and the separation plates 66 are disposed at a fixed interval. In the automatic exposure apparatus 100, due to the carriage 200 being mounted at a predetermined position in the plate accommodating section 104, the cassette 208 loaded in the carriage 200 is disposed at a fixed interval with respect to the sucker unit 10 (suction nozzles 124).

Here, in the sheet feeding controller 90, a distance between the suction nozzles 124 disposed in advance at the original positions, and the bottom plate 212 of the cassette 208 is measured, and based on the result of this measurement, a position at which the photopolymer plate 102 is separated, is set such that the photopolymer plate 102 bends between the separation plates 66 of the cassette 208 and the suction nozzles 124 at an appropriate curvature. When the photopolymer plate 102 is suction adhered to the suction nozzles 124, the suction nozzles 124 are moved upward to the above-described set position of separation.

As a result, in the sucker unit 10, the photopolymer plate 102 suction adhered to the suction nozzles 124 is bent at a fixed curvature, and the interleaf paper 118 disposed immediately below the photopolymer plate 102, or a subsequent photopolymer plate 102 is reliably separated from the photopolymer plate 102 adhered to the suction nozzles 124.

In the sucker unit 10, the amount by all of the suction nozzles 124 move until they closely contact the photopolymer plate 102 from the time at which the contact sensor 70 is turned on, is previously set. That is, when all of the suction nozzles 124 closely contact the bottom plate 212 of the cassette 208, no leakage of negative pressure from the suction nozzles 124 occurs. Therefore, a predetermined negative pressure is detected by the pressure sensor 92 provided between the vacuum pump 82 and the solenoid valves 84A and 84B.

In the sheet feeding controller 90, in a state in which an empty cassette 208 having no photopolymer plate 102 or interleaf paper 118 accommodated therein, is mounted, the suction frame 36 is moved downward at a fixed speed, and the time until detected pressure of the pressure sensor 92 reaches a predetermined value after the contact sensor 70 has been turned on, is measured. The amount by which the suction nozzles 124 move when the suction nozzles 124 suction adhere to the photopolymer plate 102, is set from the above-described measured time.

Next, with reference to the flow charts shown in FIGS. 7A, 7B, 10, 11, and 12, initial setting in the sucker unit 10 of the sheet feeding section 106, and take-out of the photopolymer plate 102 and the interleaf paper 118 from the cassette 208 based on the initial setting will be described.

Figure 7A:
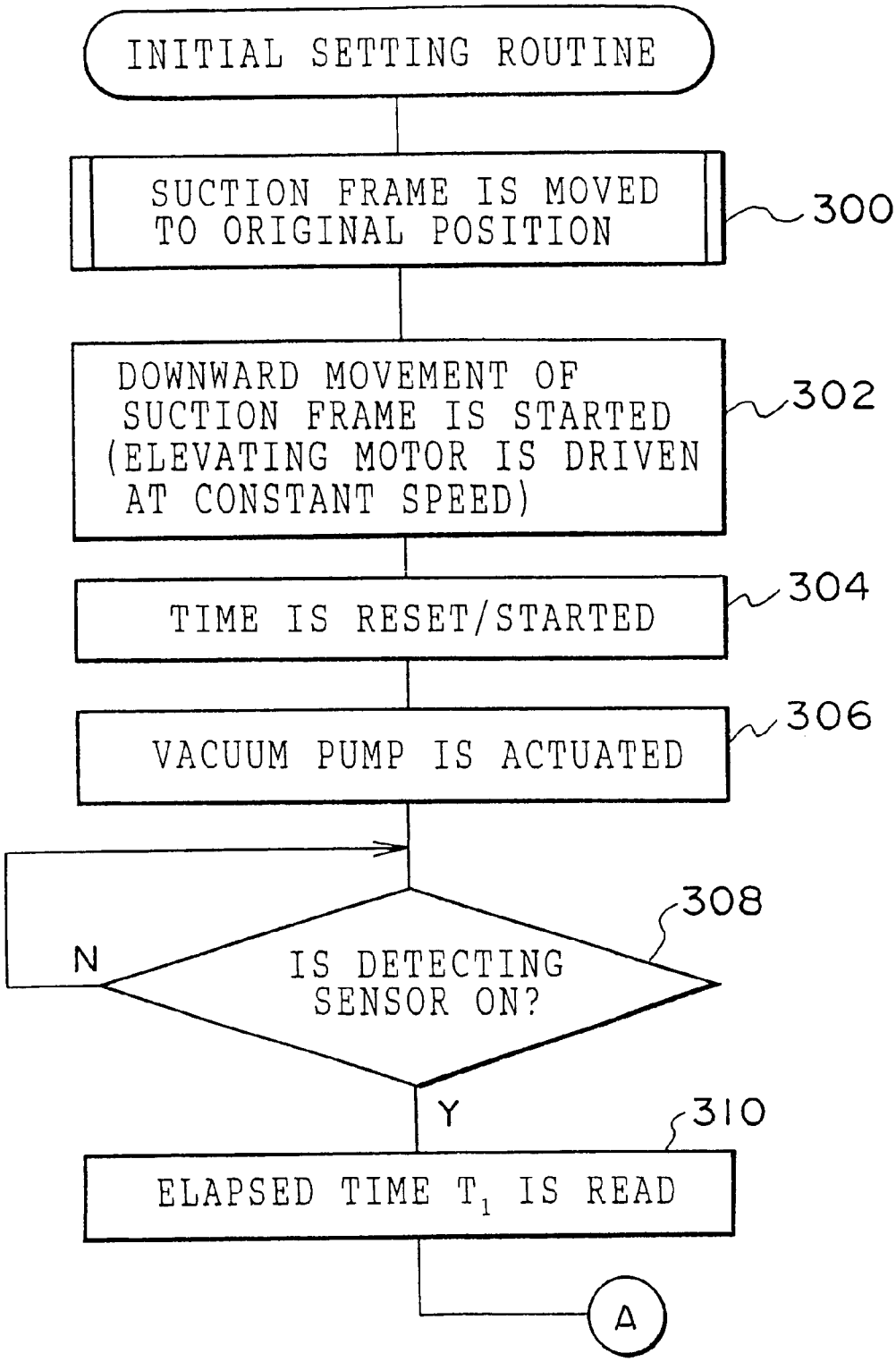
FIGS. 7A and 7B are flow diagrams showing an example of initial setting of the sucker unit.
Figure 7B:
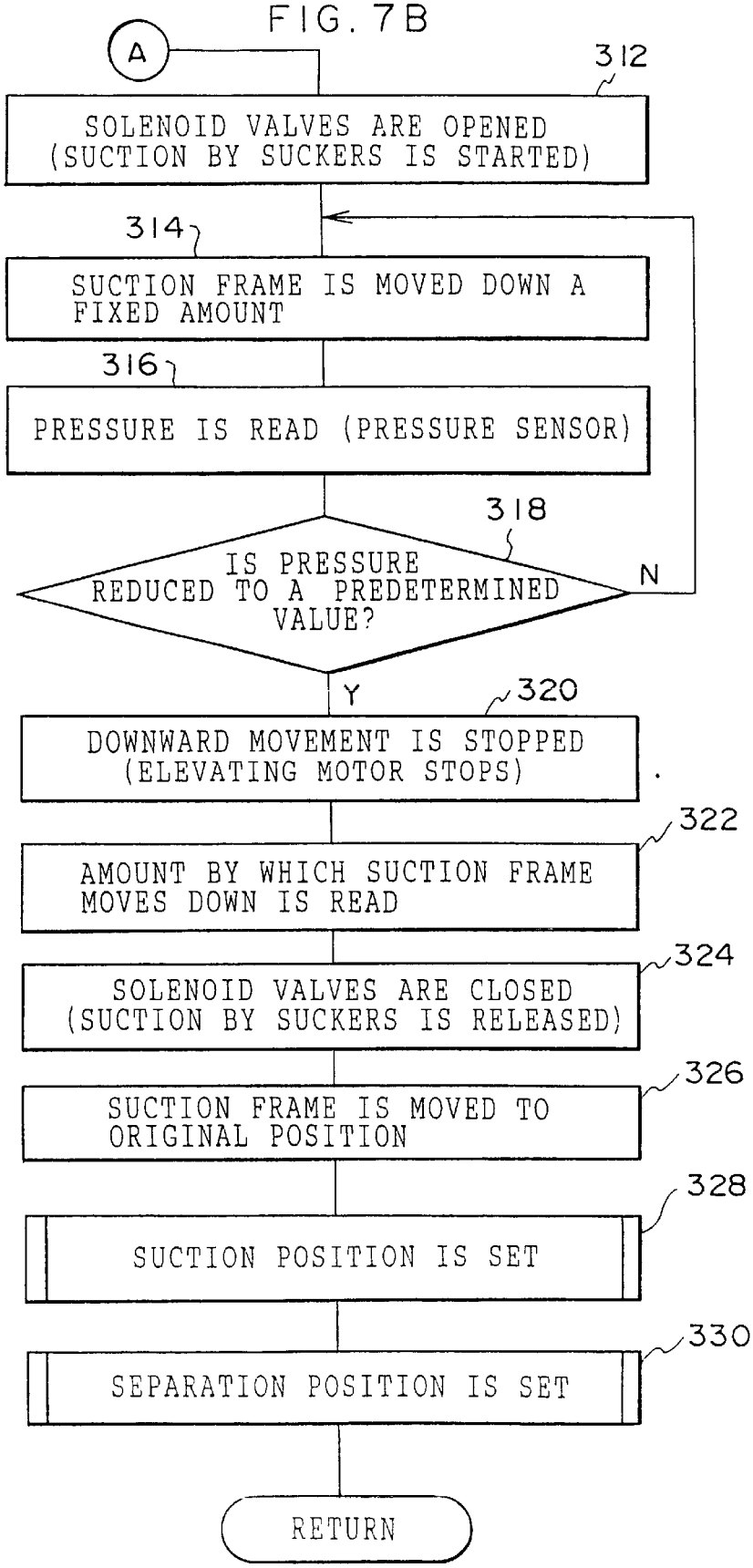

FIGS. 7A and 7B show an initial setting routine which is executed after the assembled sucker unit 10 has been mounted in the automatic exposure apparatus 100. In the initial setting routine, setting of the separation position, and setting of the amount by which the suction nozzles 124 move to closely contact the photopolymer plate 102, are carried out.

The initial setting of the sucker unit 10 is carried out in a state in which the carriage 200 having an empty cassette 208 is mounted in the plate accommodating section 104. Further, the sheet feeding controller 90 controls the elevating motor 30 so as to move up and down the suction frame 36 (suction nozzles 124) at a preset fixed speed v (for example, v=0.1 mm/sec).

In the first step 300, the suction frame 36 is moved to the original position. In this case, the suction frame 36 is moved so that the original position sensor 94 detects the bracket 38 of the suction frame 36.

In the subsequent step 302, the elevating motor 30 is driven to start downward movement of the suction nozzles 124 toward the bottom plate 212 of the cassette 208 at a fixed speed. Further, in step 304, a timer (not shown) is set and started. In step 306, the vacuum pump 82 is turned on. Thereafter, in step 308, it is confirmed as to whether the contact sensor 70 is turned on.

In this case, when the abutting portion 76 of the detecting sensor 74 abuts against the bottom plate 212 of the cassette 208 and the detecting sensor 74 contracts, the contact sensor 70 is turned on and the decision of step 308 is made affirmative. As a result, in step 310, the time measured by the timer is read as time $t_1$.

In step 312, the solenoid valves 84A and 84B are opened and negative pressure is fed for the suction nozzles 124. In step 314, the suction frame 36 is further moved downward a fixed amount (for example, 0.1 mm), and a pressure detected by the pressure sensor 92 is read (step 316). Further, in step 318, it is determined whether the read pressure comes at a predetermined value.

In other words, when the suction nozzles 124 are moved by the contact sensor 70 to a predetermined position with respect to the bottom plate 212 of the cassette 208, a determination is made, from the pressure detected by the pressure sensor 92, as to whether all of the suction nozzles 124 abut against and suction adhere to the bottom plate 212 of the cassette 208 while moving down the suction nozzles 124 by a fixed amount.

When all of the suction nozzles 124 suction adhere to the bottom plate 212 of the cassette 208 and the pressure detected by the pressure sensor 92 decreases to a predetermined value, the decision of step 318 is made affirmative, and the process proceeds to step 320.

In step 320, downward movement of the suction frame 36 is stopped by stopping the operation of the elevating motor 30. In step 322, an amount Δy by which the suction nozzles 124 (suction frame 36) move (that is, an amount of lowering) after the bottom plate 212 of the cassette 208 is detected by the contact sensor 70, is read.

In step 324, feeding of negative pressure for the suction nozzles 124 is stopped by closing the solenoid valves 84A and 84B, and suction of the bottom plate 212 by the suction nozzles 124 is released. In step 326, the suction frame 36 is moved back to the original position by driving to reverse elevating motor 30.

When the operation of the suction frame 36 is thus completed, in step 328, an amount of movement Δy by which all of the suction nozzles 124 suction adhere to the photopolymer plate 102 with respect to the position at which the photopolymer plate 102 is detected by the contact sensor 70, is set from the read amount of movement Δy.

Figure 9A:
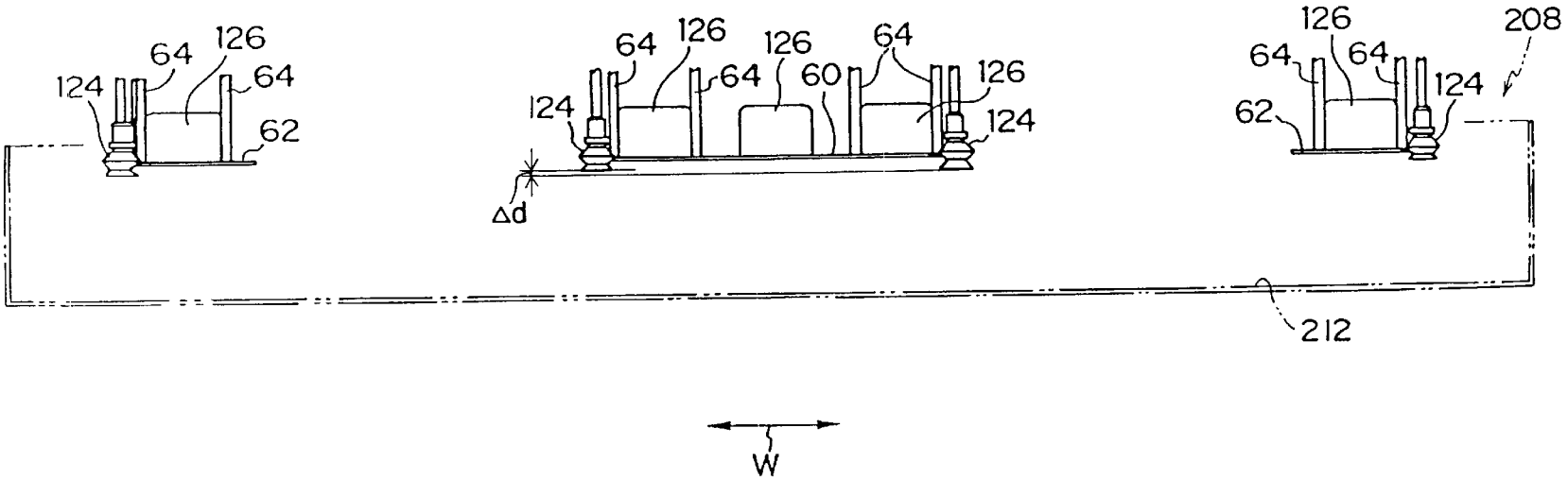
FIGS. 9A and 9B are schematic diagrams which each show relative positions of the suckers of the sucker unit with respect to the bottom plate of the cassette.

That is, as shown in FIG. 9A, the plurality of suction nozzles 124 provided in the suction frame 36 may not be arranged at the same height unless high accurate positioning of the suction nozzles 124 is carried out at the time of assembling. In the state in which the suction nozzles 124 are not arranged at the same height as described above, even if some of the suction nozzles 124 are about to suction adhere to the photopolymer plate by feeding negative pressure therefor in the state of abutting against the photopolymer plate 102, leakage of negative pressure from suction nozzles 124 which have not abutted against the photopolymer plate 102 occurs. Accordingly, it becomes difficult for the suction nozzles 124 to suction adhere to the photopolymer plate 102.

Figure 9B:
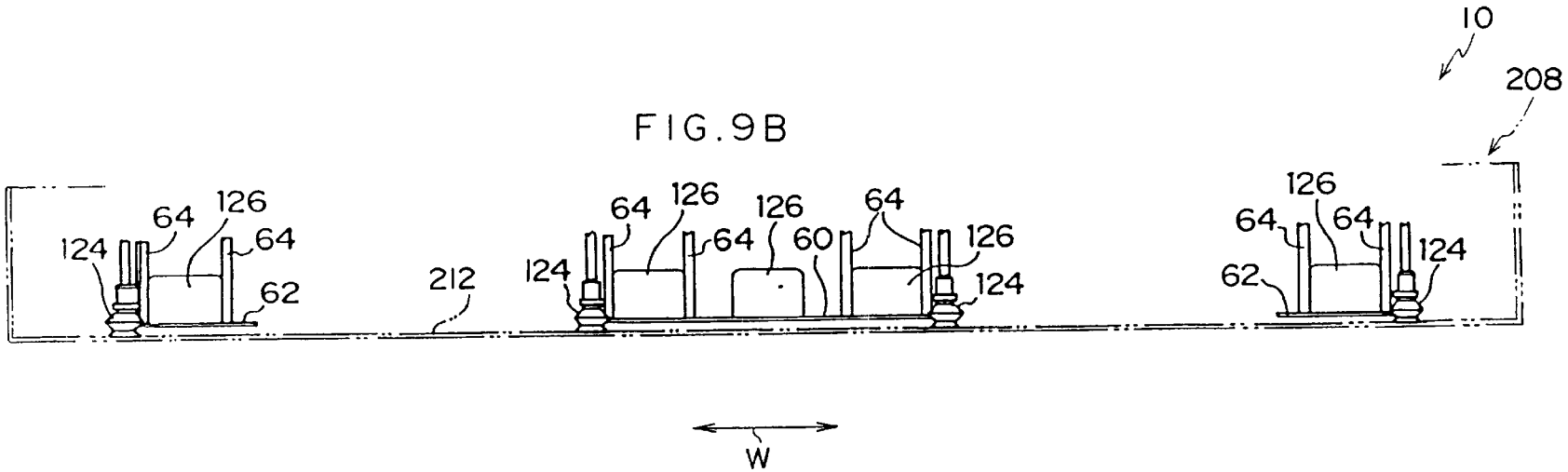

Here, due to the suction frame 36 being moved downward so that all of the plurality of suction nozzles 124 abut against the photopolymer plate 102, the suction nozzles 124 can all suction adhere to the photopolymer plate 102. For example, when the greatest difference in height between the suction nozzles 124 is shown as an amount of heightwise difference Δd, all of the suction nozzles 124 can be made to abut against the photopolymer plate 102 as shown in FIG. 9B by moving down the suction frame 36 the amount of heightwise difference Δd or greater after any suction nozzle 124 first abuts against the photopolymer plate 102.

Here, in the sucker unit 10, the photopolymer plate 102 can reliably be suction adhered to all of the suction nozzles 124 by measuring the amount of movement Δy required for allowing all of the suction nozzles 124 to suction adhere to the bottom plate 212 after the bottom plate 212 is detected by the contact sensor 70.

In step 330, the photopolymer plate 102 suction adhered to the suction nozzles 124 is lifted up, and a position of separation $Y_s$ (see FIG. 8) at which the photopolymer plate 102 is bent between the suction nozzles 124 and the separation plates 66 mounted in the cassette 208 at a predetermined curvature, is set.

The distance $y_1$ between the bottom surface 212 of the cassette 208 and the separation plates 66 is determined in advance. The position of separation $Y_s$ can be set by a calculation from the distance $y_1$, moving speed v of the suction frame 36, time $t_1$ required until the suction nozzles 124 move from the original position and the contact sensor 70 is turned on, and Δy.

Figure 8:
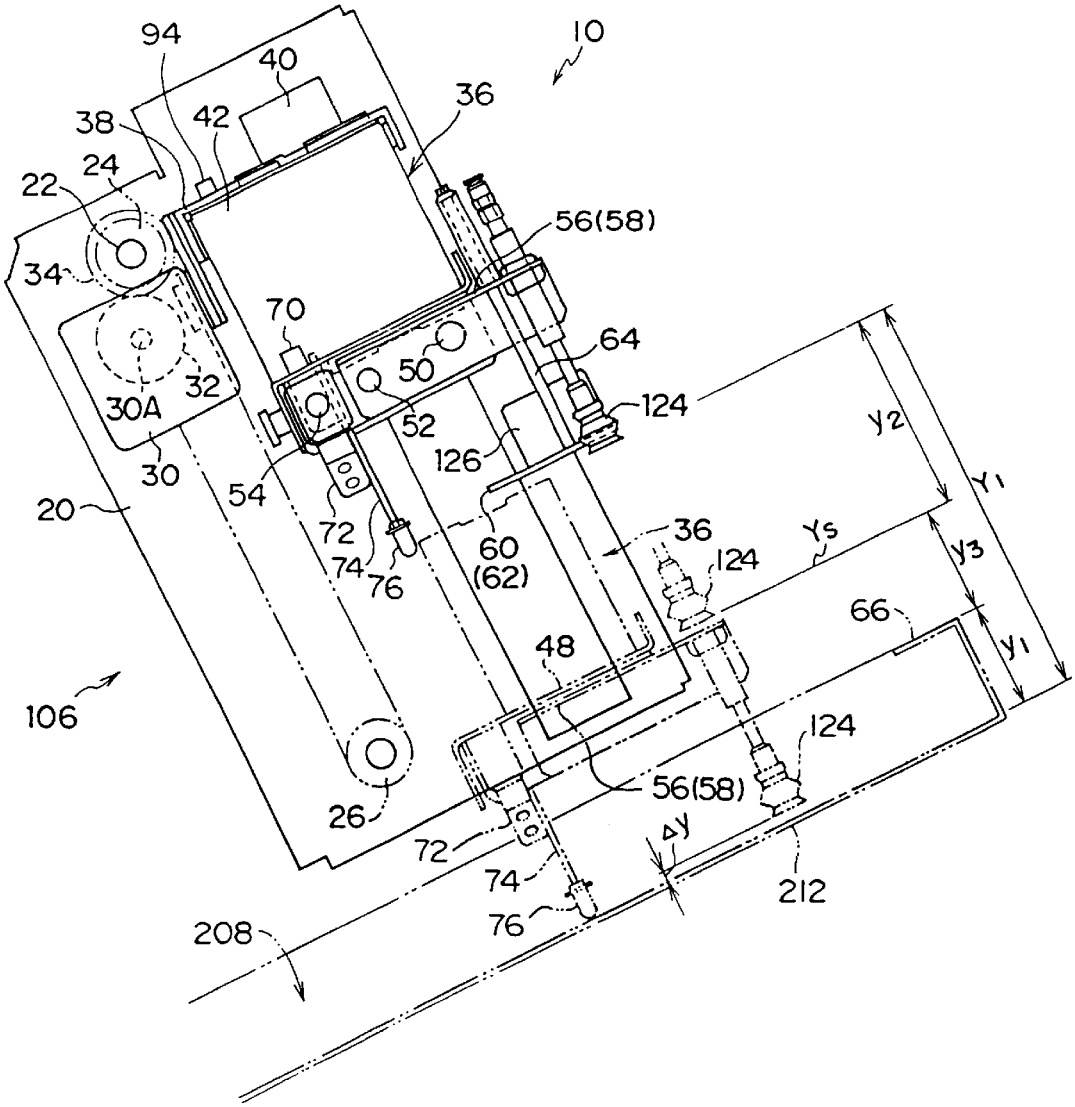
FIG. 8 is a schematic diagram of the sucker unit, which shows the position of the sucker with respect to the cassette.

In other words, as illustrated in FIG. 8, the cassette 208 is mounted at a predetermined position with respect to the suction nozzles 124 (suction frame 36) located at the original positions. The distance between the bottom plate 212 of the cassette 208 and the suction nozzles 124 located at the original position, represented by $Y_1$, is given by the following expression:

$$Y_1=t_1\times v+\Delta y.$$

Further, the distance $y_2$ between the suction nozzles 124 located at the original position and the separation plates 66 is calculated as described below from the distance $y_1$ between the bottom plate 212 of the cassette 208 and the separation plates 66, and the distance $y_2$ between the suction nozzles 124 located at the original position and the separation plates 66, which allows the photopolymer plate 102 to bend at an appropriate curvature:

$$y_2=Y_1-(y_1+y_3)$$

Accordingly, a position apart from the original position by the distance $y_2$ becomes the position of separation $Y_s$.

Figure 10:
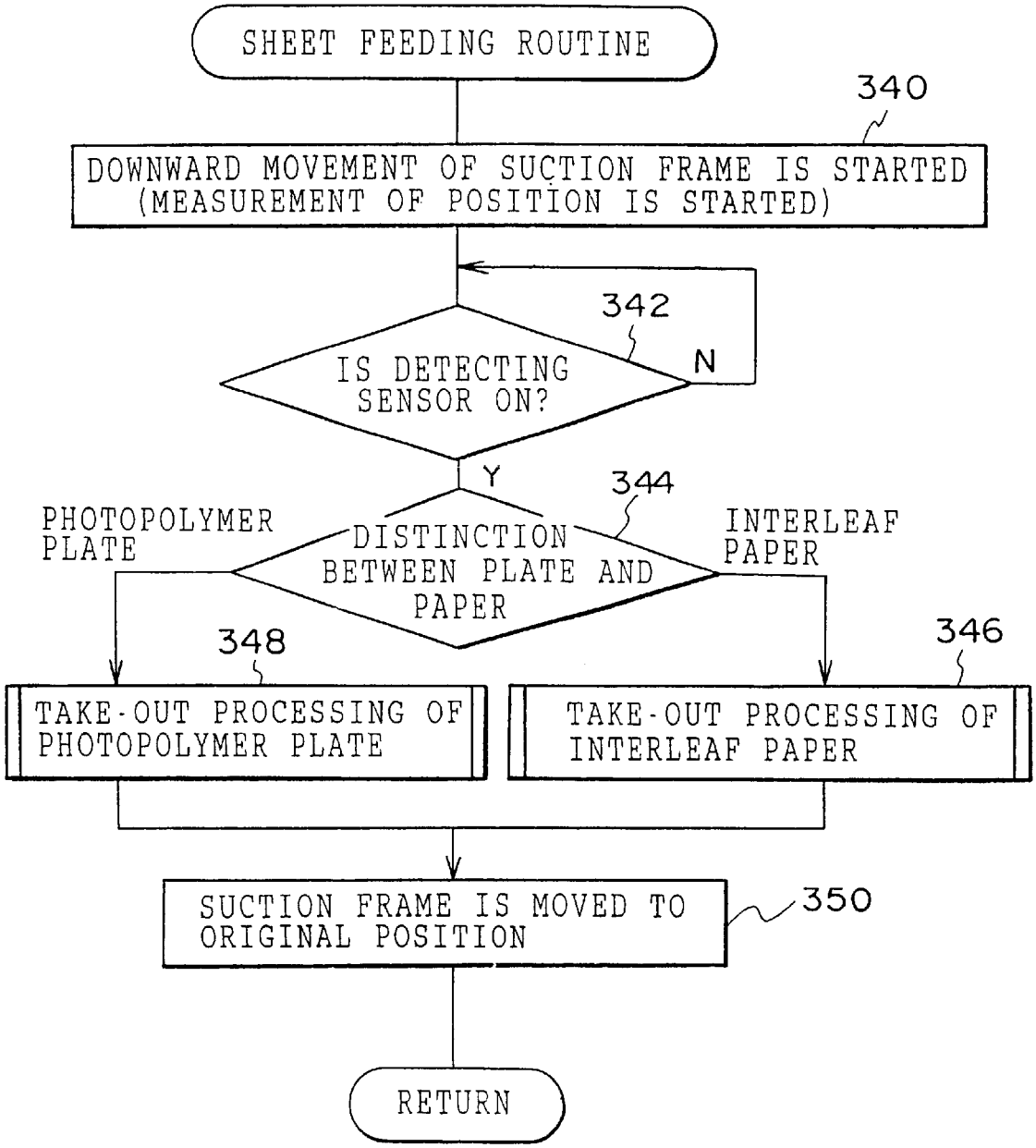
FIG. 10 is a flow diagram showing an example of sheet feeding processing using the sucker unit.
Figure 11:
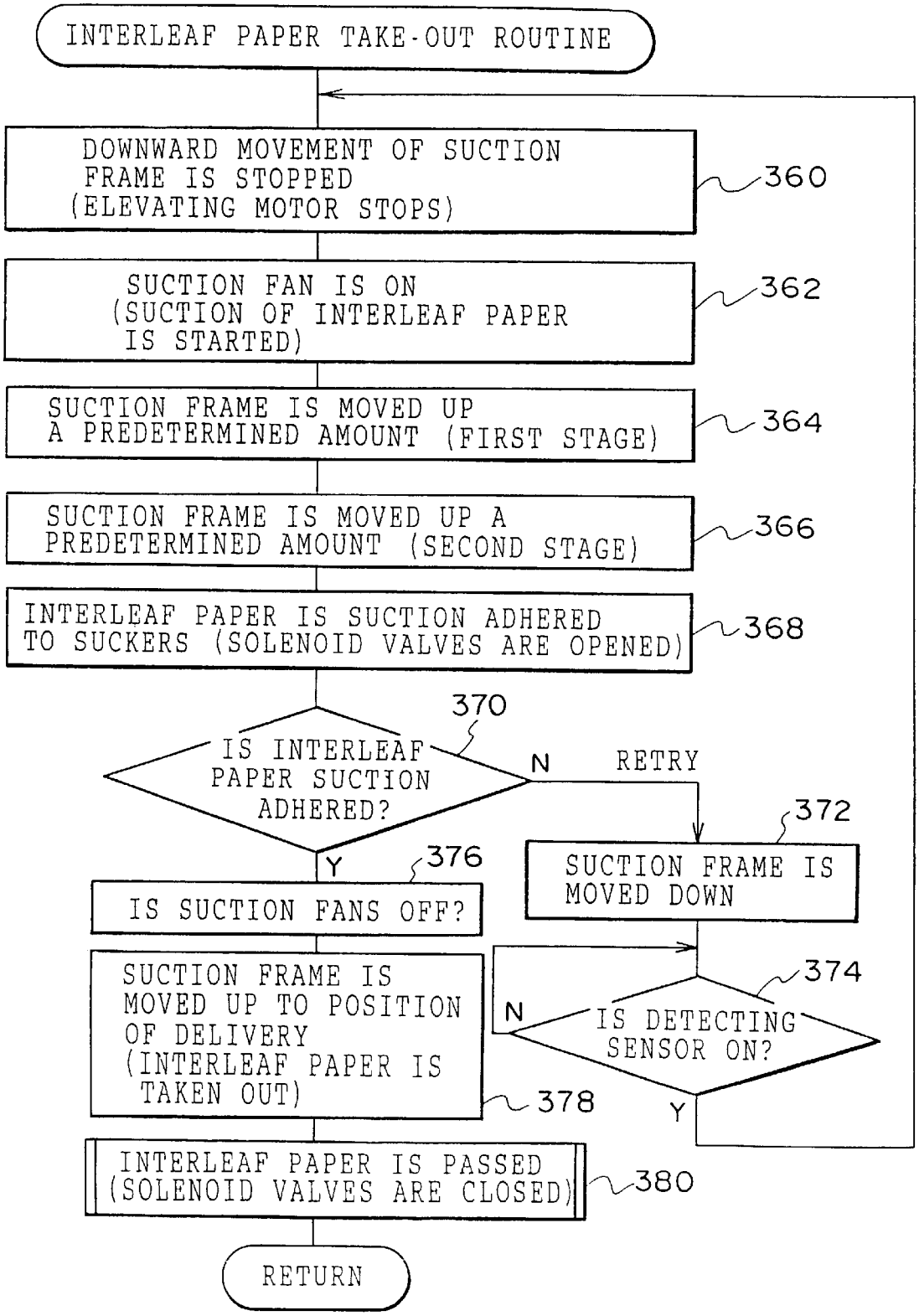
FIG. 11 is a flow diagram showing an example of take-out processing of interleaf paper from a cassette.
Figure 12:
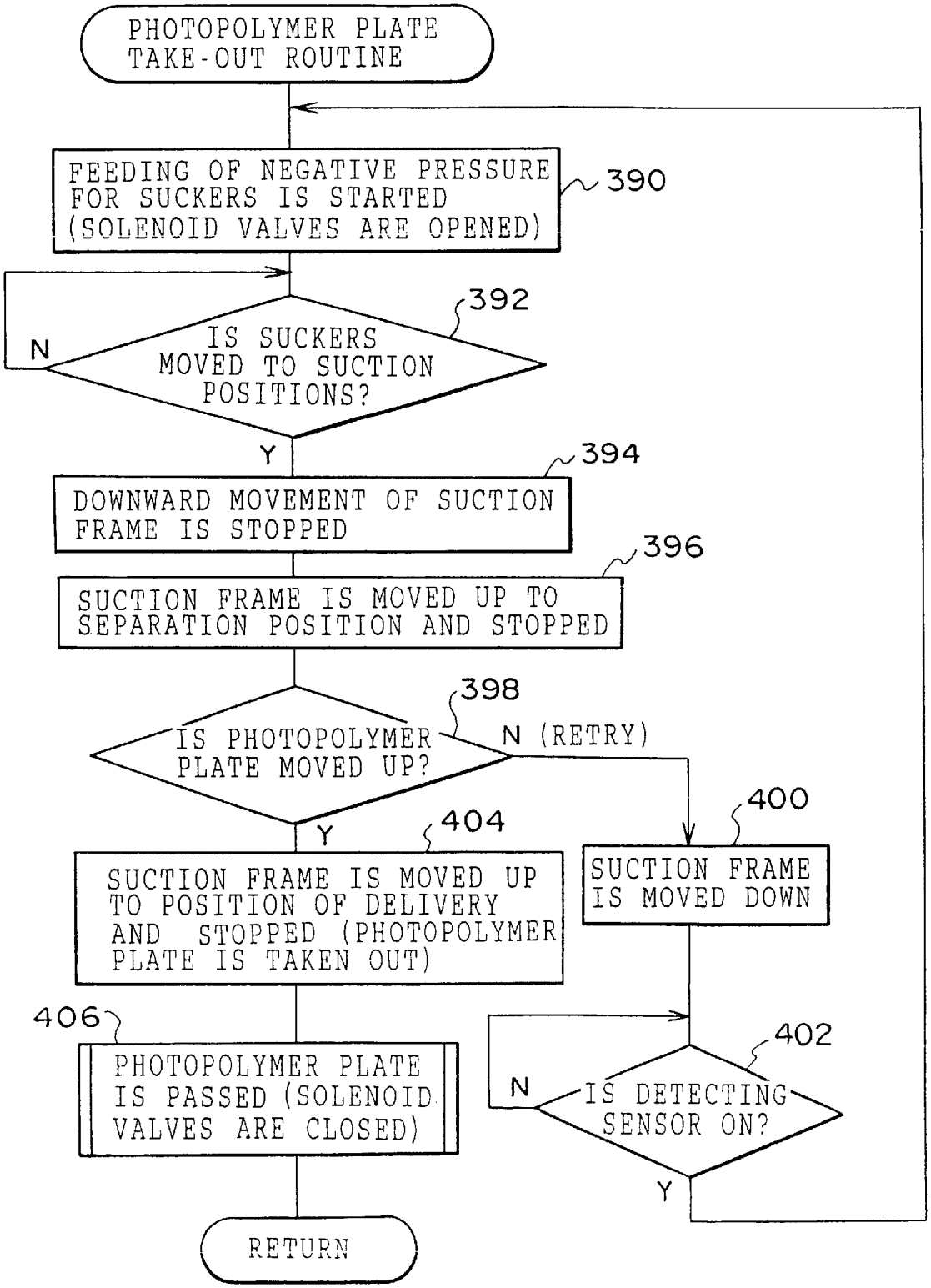
FIG. 12 is a flow diagram showing an example of take-out processing of photopolymer plates from a cassette to which the present invention is applied.

FIGS. 10 to 12 schematically show take-out processing of the photopolymer plate 102 and the interleaf paper 118 using the sucker unit 10 in which the initial setting is carried out as described above.

The flow chart shown in FIG. 10 is executed by giving an instruction for taking out the photopolymer plate 102 from the cassette 208 mounted in the plate accommodating section 104 when exposure of images on the photopolymer plate 102 is carried out in the automatic exposure apparatus 100. Prior to sheet feeding processing, in the sucker unit 10, the suction nozzles 124 are in advance moved to the original positions and placed in a waiting state thereat.

In the sheet feeding processing, first, in step 340, driving the elevating motor 30 is started and the suction nozzles 124 are moved downward toward the cassette 208 at a fixed speed v. In the sheet feeding controller 90, the positions at which the suction nozzles 124 are moved are properly controlled by using a pulse motor or a DC motor having an encoder.

Subsequently, in step 342, it is confirmed as to whether the contact sensor 70 abuts against the uppermost photopolymer plate 102 or interleaf paper 118, which is accommodated in the cassette 208.

When the detecting shaft 74 moves toward the cassette 208 together with the suction nozzles 124 and the abutting portion 76 at the end of the detecting shaft 74 abuts against the photopolymer plate 102 or the interleaf paper 118 at the uppermost position, the contact sensor 70 is turned on and the decision of step 342 is made affirmative. The process proceeds to step 344. In step 344, it is determined by the plate/paper discrimination sensor 72 whether the uppermost layer is the photopolymer plate 102 or the interleaf paper 118.

When it is determined that the interleaf paper 118 is located at the uppermost position, the process proceeds to step 346 in which take-out processing of the interleaf paper 118 is started.

FIG. 11 shows an example of the take-out processing of the interleaf paper 118 in the sucker unit 10. The flow chart shown in FIG. 11 is executed by making an determination that the interleaf paper 118 is located at the uppermost position of the cassette 208. In the first step 360, downward movement of the suction nozzles 124 is stopped by stopping the operation of the elevating motor 30.

The operation of stopping the downward movement of the suction nozzles 124 may be carried out prior to the process of step 344 in the above-described flow chart (FIG. 10). Further, when the interleaf paper 118 is taken out, switching of the conveying path is carried out in the conveying switch portion 136 so that the interleaf paper 118 is conveyed from the shared conveying portion 128 to the interleaf paper conveying portion 134. Further, when the interleaf paper 118 is constantly located at the uppermost position, take-out of the interleaf paper 118 may first be carried out without making a distinction between the plate and the paper.

In the subsequent step 362, the suction fans 126 are actuated to suck in air in the vicinity of the surface of the interleaf paper 118. In the sucker unit 10, when the contact sensor 70 is turned on, the fan bases 60 and 62 are brought into the state of moving close to the surface of the uppermost interleaf paper 118 at a predetermined distance. Due to the suction fans 126 being actuated in the above-described state, the interleaf paper 118 is released from closely contacting the photopolymer plate 102 disposed immediately below the interleaf paper 118, and the interleaf paper 118 is partially lifted up by the suction fans 126.

Alternatively, after the contact sensor 70 has been turned on, the suction fans 126 may be actuated with the suction nozzles 124 being moved a fixed amount (for example, an amount of movement Δd until all of the suction nozzles 124 abut and press against the interleaf paper 118).

In the subsequent step 364, first, the elevating motor 30 is driven to reverse a little and the suction frame 36 is lifted up to a small extent (for example, by a distance of 3 mm or thereabouts). As a result, the suction fans 126 move upward a little and the interleaf paper 118 sucked by the suction fans 126 is also raised to a small extent. Accordingly, a region of the interleaf paper 118 which is released from closely contacting the photopolymer plate 102, is extended.

In step 366, the suction frame 36 is moved upward (for example, by a distance of 2 mm or thereabouts) until the suction nozzles 124 are lifted up, that is, until the contact sensor 70 is turned off, and the upper end of the interleaf paper 118 is raised away from an underlying photopolymer plate 102.

When the fan bases 60 and 62 are moved upward step by step as described above, the state in which the uppermost interleaf paper 118 and the underlying photopolymer plate 102 closely contact each other, is released due to the suction force of the suction fans 126, and the interleaf paper 118 is raised away from the photopolymer plate 102. In step 368, negative pressure is fed for the suction nozzles 124 by, for example, opening the solenoid valves 84A and 84B for feeding negative pressure for the suction nozzles 124, and the interleaf paper 118 is suction adhered to the suction nozzles 124. The vacuum pump 82 is turned on at a predetermined timing during downward movement of the suction nozzles 124 from the original positions or during operation of the automatic exposure apparatus 100. Further, the fan bases 60 and 62 are moved upward at two stages, but these fan bases may also be moved upward to a position corresponding to the position in step 366 in a single operation of moving upward.

In step 370, it is confirmed as to whether the suction nozzles 124 reliably suction adhere to the interleaf paper 118. A determination as to whether the suction nozzles 124 suction adhere to the interleaf paper 118, can be made from, for example, the pressure detected by the pressure sensor 92. That is, so long as all of the suction nozzles 124 suction adhere to the interleaf paper 118, even if negative pressure leaks from the interleaf paper 118, the pressure becomes lower as compared with a case in which the suction nozzles 124 do not suction adhere to the interleaf paper 118. Accordingly, the above-described determination can be made. When it is determined that the suction nozzles 124 do not suction adhere to the interleaf paper 118 (when the decision of step 370 is negative), the process proceeds to steps 372 and 374 in which retry is set.

On the other hand, when the suction nozzles 124 suction adhere to the interleaf paper 118 (when the decision of step 370 is affirmative), the process proceeds to step 376 in which the suction fans 126 are turned off. Further, the suction nozzles 124 are moved upward to the position of delivery to the shared conveying portion 128 so that the interleaf paper 118 is transferred to the shared conveying portion 128, and the solenoid valves 84A and 84B are closed to release suction holding of the interleaf paper 118 by the suction nozzles 124.

When the uppermost interleaf paper 118 is taken out from the cassette 208 as described above, the process proceeds to step 350 in FIG. 10 in which the suction frame 36 (suction nozzles 124) is moved to the original position. When the photopolymer plates 102 are successively taken out, downward movement of the suction frame 36 from the position of delivery may be started without moving the suction frame 36 to the original position.

When the uppermost interleaf paper 118 is thus taken out from the cassette 208, the photopolymer plate 102 is located at the uppermost position of the cassette 208. As a result, in the flow chart shown in FIG. 10, a determination is made in step 344 that the photopolymer plate 102 is located at the uppermost position. The process proceeds to step 348 in which take-out processing of the photopolymer plate 102 is carried out.

FIG. 12 schematically shows take-out processing of the photopolymer plate 102. When the photopolymer plate 102 is taken out, the conveying switch portion 36 is switched and the conveying path from the shared conveying portion 128 to the photopolymer plate conveying portion 130 is formed.

In order to take out the photopolymer plate 102, first, in step 390, the solenoid valves 84A and 84B are opened to start feeding of negative pressure for the suction nozzles 124, and the suction nozzles 124 are further moved downward. Further, in step 392, it is determined whether the suction nozzles 124 each have arrived at the sucking position. When the suction nozzles 124 each have arrived at the sucking position and the decision of step 392 is affirmative, the process proceeds to step 394 in which downward movement of the suction nozzles 124 is stopped.

In other words, in the sucker unit 10, the suction nozzles 124 are further moved downward from the positions detected by the contact sensor 70 to the predetermined sucking positions by an amount of movement $\Delta y$. As a result, all of the plurality of suction nozzles 124 provided in the suction frame 36 abut against the photopolymer plate 102 and suction adhere to the photopolymer plate 102 due to negative pressure fed therefor.

When the suction nozzles 124 have all arrived at the positions where the suction nozzles suction adhere to the photopolymer plate 102, in step 396, the suction nozzles 124 are each moved upward to a predetermined separation position $Y_s$.

As a result, the photopolymer plate 102 is lifted up by the suction nozzles 124 to the separation position $Y_s$ and bent between the suction nozzles 124 and the separation plates 66 at a predetermined curvature. At this time, the respective positions of the suction nozzles 124 are set such that the photopolymer plate 102 is suitably bent between the suction nozzles 124 and the separation plates 66. Therefore, the interleaf paper 118 closely contacting the photopolymer plate 102 raised by the suction nozzles 124, and a subsequent photopolymer plate 102 are reliably separated from the raised photopolymer plate 102.

In step 398, it is determined whether the photopolymer plate 102 has reliably been suction adhered to the suction nozzles 124. When the photopolymer plate 102 has not been suction adhered to the suction nozzles 124 (when the decision of step 398 is negative), the process proceeds to steps 400 and 402 in which retry of taking out the photopolymer plate 102 is carried out.

When the uppermost photopolymer plate 102 is thus suction adhered to all of the plurality of suction nozzles 124 (when the decision of step 398 is affirmative), the process proceeds to step 404 in which the suction nozzles 124 are moved upward to the position of delivery to the shared conveying portion 128. Subsequently, when the photopolymer plate 102 suction adhered to the suction nozzles 124 is nipped by the rollers 128A and 128B of the shared conveying portion 128, the solenoid valves 84A and 84B are closed and suction of the photopolymer plate 102 by the suction nozzles 124 is released.

As a result, the photopolymer plate 102 lifted up from the cassette 208 is transferred to the shared conveying portion 128 and conveyed to the plate supplying section 108 while being pulled out from the cassette 208.

When the photopolymer plate 102 is taken out from the cassette 208 and conveyed into the shared conveying portion 128 as described above, in step 350 shown in FIG. 10, the suction frame 36 (suction nozzles 124) is moved to the original position and is placed in a waiting state thereat until the subsequent photopolymer plate 102 is taken out. When the photopolymer plates 102 are successively taken out, movement of the suction frame 36 from the original position may be started. Alternatively, the suction nozzles 124 may be moved from the position of delivery after the subsequent interleaf paper 118 is taken out.

As described above, the positions at which the photopolymer plate 102 is suction adhered to the plurality of suction nozzles 124, are set, and based on the result of this setting, the suction nozzles 124 are moved. Therefore, even if the positions at which the plurality of suction nozzles 124 are mounted, may not be provided at the same height, the photopolymer plate 102 can reliably be suction adhered to all of the suction nozzles 124.

Accordingly, when the plurality of suction nozzles 124 are mounted in the sucker unit 10, high accurate positioning of the suction nozzles 124 becomes unnecessary. Therefore, mounting of the suction nozzles 124 in the sucker unit 10 is extremely facilitated.

Further, the separation positions of the suction nozzles 124 are set by actually moving the suction nozzles 124. For this reason, at the time of assembling the sucker unit 10, it is not necessary that the original positions of the suction nozzles 124 be set or that the positions at which the suction nozzles 124 are stopped with respect to the separation plates 66 of the cassette 208, be determined with high accuracy. Accordingly, adjustment of positions of the suction nozzles 124 at the time of assembling is extremely facilitated.

As a result, assembling efficiency at the time of assembling the sucker unit 10 by which the photopolymer plate 102 can reliably be taken out from the cassette 208, can be improved. Further, at the time of maintenance for the sucker unit 10, such as replacement of the suction nozzles 124, it is not necessary that the suction nozzles 124 be mounted and positioned with high accuracy. Therefore, maintenance of the sucker unit 10 can also be made easy.

The above-described embodiment is merely one example of the present invention, and the structure of the sheet feeder according to the present invention is not limited to the same. The present embodiment was described using the photopolymer plate 102 as the plate-shaped member, but the present invention can be applied to feeding of various printing plates, for example, pre-sensitized plates (PS plates), in addition to the photopolymer plate 102.

Further, in the present embodiment, the structure in which the photopolymer plates 102 and interleaf papers 118 are alternately stacked, was described as an example. However, only printing plates such as photopolymer plates may also be stacked and accommodated in a cassette. Moreover, in the present embodiment, the sucker unit 10 provided in the automatic exposure apparatus 100 was described as an example. However, the sheet feeder to which the present invention is applied, can be applied to any processing apparatus in which printing plates stacked and accommodated in the cassette may be taken out one-by-one, in addition to the automatic exposure apparatus 100.

Furthermore, the present invention can also be applied to the sheet feeder for taking out not only printing plates such as photopolymer plates, but also various plate-shaped members.

What is claimed is:

1. A sheet feeding method for feeding plate-shaped members, in which an uppermost layer of plate-shaped members stacked on a bottom plate of a cassette which is disposed so as to face a plurality of suction nozzles, is raised by being suction adhered to the plurality of suction nozzles and taken out from the cassette, said method comprising the steps of:

moving said suction nozzles from preset original positions to the bottom plate of the cassette and detecting, by an approach detecting portion, that said suction nozzles come close to the uppermost layer of the plate-shaped members and move to a first position; and moving down said plurality of suction nozzles based on an amount of movement, which is set so that said suction nozzles each abut against the uppermost layer of the plate-shaped members, thereby causing the suction nozzles to suction the uppermost layer of the plate-shaped members.

2. The method of claim 1, further comprising the step of:

moving said plurality of suction nozzles and said approach detecting portion in an integrated manner toward the bottom plate of the cassette having no plate-shaped member accommodated therein, detecting, by said approach detecting portion, that said suction nozzles come close to the bottom plate of the cassette and move to the first position, measuring a distance by which said suction nozzles move until a detected pressure of a pressure detecting portion disposed between the suction nozzles and a negative pressure source reaches a predetermined value, and setting the distance by which said suction nozzles move, as said amount of movement.

3. The method of claim 1, further comprising the step of:

when said suction nozzles suction adhering to the plate-shaped member is moved upward to a second position with respect to separation plates provided in the cassette at predetermined positions facing a peripheral edge of the plate-shaped member, so that the plate-shaped member is bent between said suction nozzles and said separation plates at a predetermined curvature, setting respective positions of the suction nozzles with respect to the original positions based on a distance by which said suction nozzles move from said original positions until the suction nozzles suction adhere to the bottom plate of the cassette.

4. The method of claim 1, further comprising the step of:

when plate-shaped members are successively taken out, restarting to move said suction nozzles from the original positions.

5. The method of claim 1, further comprising the step of:

when plate-shaped members are successively taken out, restarting to move the suction nozzles from a third position where the suction nozzles have delivered the plate-shaped members to a conveying portion.

6. The method of claim 2, further comprising the step of:

when said suction nozzles suction adhering to the plate-shaped member is moved upward to a second position with respect to separation plates provided in the cassette at predetermined positions facing a peripheral edge of the plate-shaped member, so that the plate-shaped member is bent between said suction nozzles and said separation plates at a predetermined curvature, setting respective positions of the suction nozzles with respect to the original positions based on a distance by which said suction nozzles move from said original positions until the suction nozzles suction adhere to the bottom plate of the cassette.

7. The method of claim 2, wherein the approach detection mechanism includes a detecting shaft having an abutting portion which abuts against a surface, and a sensor, said sensor being activated when the abutting portion abuts against a surface to at least partially retract the detecting shaft.

8. A method for removing a plate-shaped member for sheet feeding from a stack of plate-shaped members supported on a bottom plate of a cassette, the method comprising the steps of:

positioning suction nozzles at preset original positions relative to the bottom plate of the cassette, facing the stack;

moving the suction nozzles from the preset original positions to a first position in close proximity to the stack based on information from an approach detection mechanism;

moving the suction nozzles an additional amount predetermined to abut each suction nozzle against the stack;

withdrawing the suction nozzles from the stack while applying reduced pressure to the suction nozzles to suction adhere a plate shaped member thereto and remove the plate-shaped member from the stack for sheet feeding.

9. The method of claim 8, further comprising the step of setting said additional amount predetermined to abut each suction nozzle, by:

(i) when the cassette is empty of plate-shaped members, moving the suction nozzles and the approach detection mechanism together with one another toward the bottom plate of the cassette until the suction nozzles are in a location of close proximity to the bottom plate based on information from the approach detection mechanism;

(ii) moving the suction nozzles further toward the bottom plate of the cassette while applying reduced pressure to the suction nozzles until a pressure measurement reaches a predetermined reduced level; and (iii) setting the distance moved by the suction nozzles from the location of close proximity until the pressure measurement reaches the predetermined reduced amount as said additional amount predetermined to abut each suction nozzle.

10. The method of claim 8, wherein the cassette includes separation plates, the method further comprising the step of moving the suction nozzles upward to a second position with respect to the separation plates, with a plate-shaped member suction adhered to the suction nozzles so that the plate-shaped member is bent between the suction nozzles and the separation plates at a predetermined curvature.

11. The method of claim 8, wherein when the plate-shaped members are to be successively removed, further comprising the step of returning the suction nozzles to the preset original positions for removing the next plate-shaped member.

12. The method of claim 8, wherein when the plate-shaped members are to be successively removed, further comprising the step of moving the suction nozzles to a third position where the suction nozzles have delivered the plate-shaped members to a conveying portion.

13. A sheet feeder for plate-shaped members, the sheet feeder comprising:

a cassette in which plate-shaped members are accommodated in a stack;

a suction unit including at least one suction nozzle which is capable of suction adhering to a plate-shaped member when supplied with reduced pressure, a frame supporting the suction nozzle, and a motor which drives movement of the frame so that the suction nozzle is moved close to and apart from a plate-shaped member in the cassette, and a control system which controls operation of the motor for controlling a distance between the suction nozzle and the plate-shaped member.

14. A sheet feeder for plate-shaped members according to claim 13, wherein said control system includes an approach detection sensor, a controller, and a pressure sensor.

15. A sheet feeder for plate-shaped members according to claim 13, wherein the motor moves the frame step-wise at a fixed time interval.

16. A sheet feeder for plate-shaped members according to claim 14, wherein the motor moves the frame step-wise at a fixed time interval.

17. A sheet feeder for plate-shaped members according to claim 14, wherein said controller includes logic for determining positions at which to stop movement of said suction nozzles by using a distance detected by said approach detection sensor.

18. A sheet feeder for plate-shaped members according to claim 14, wherein said controller includes logic for determining positions at which to stop movement of said suction nozzles by using a pressure value detected by said pressure sensor.

19. A sheet feeder for plate-shaped members according to claim 15, wherein said controller includes logic for determining positions at which to stop movement of said suction nozzles by using a distance detected by said approach detection sensor.

20. A sheet feeder for plate-shaped members according to claim 15, wherein said controller includes logic for determining positions at which to stop movement of said suction nozzles by using a pressure value detected by said pressure sensor.

* * * * *